US012396609B2

(12) United States Patent
Gong et al.

(10) Patent No.: US 12,396,609 B2
(45) Date of Patent: Aug. 26, 2025

(54) METHOD, APPARATUS AND SYSTEM FOR CONTROLLING CLEANING ROBOT, AND STORAGE MEDIUM

(71) Applicants: YUNJING INTELLIGENCE (SHENZHEN) CO., LTD., Guangdong (CN); YUNJING INTELLIGENCE INNOVATION (SHENZHEN) CO., LTD., Guangdong (CN)

(72) Inventors: Ding Gong, Guangdong (CN); Yuqian Wang, Guangdong (CN); Hailong Sun, Guangdong (CN); Jie Qian, Guangdong (CN)

(73) Assignees: YUNJING INTELLIGENCE (SHENZHEN) CO., LTD., Shenzhen (CN); YUNJING INTELLIGENCE INNOVATION (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 19/017,809

(22) Filed: Jan. 13, 2025

(65) Prior Publication Data

US 2025/0143529 A1 May 8, 2025

Related U.S. Application Data

(63) Continuation of application No. PCT/CN2023/109650, filed on Jul. 27, 2023.

(30) Foreign Application Priority Data

Jul. 29, 2022 (CN) ..... 202210910931.X

(51) Int. Cl.
*A47L 9/30* (2006.01)
*A47L 11/40* (2006.01)

(52) U.S. Cl.
CPC ..... *A47L 11/4011* (2013.01); *A47L 11/4061* (2013.01); *A47L 2201/04* (2013.01)

(58) Field of Classification Search
CPC . B25J 19/02; B25J 19/022; B25J 11/00; B25J 9/16; B25J 9/00; B25J 11/0085;
(Continued)

(56) References Cited

U.S. PATENT DOCUMENTS 6,459,955 B1 * 10/2002 Bartsch ..... A47L 9/00 318/587
7,574,282 B2 * 8/2009 Petersson ..... A01D 34/008 701/25

(Continued)

FOREIGN PATENT DOCUMENTS

CN 106793905 A 5/2017
CN 108338749 A 7/2018

(Continued)

OTHER PUBLICATIONS

Kabir et al., Automated Planning for Robotic Cleaning Using Multiple Setups and Oscillatory Tool Motions, 2017, IEEE, p. 1364-1377 (Year: 2017).*

(Continued)

*Primary Examiner* — Marc McDieunel

(57) ABSTRACT

The present disclosure provides a control method, device and system of a cleaning robot and a storage medium, and the method includes: obtaining one or at least two preset frequencies of an edge patching cleaning task, and controlling the cleaning robot to perform the edge patching cleaning task on a preset cleaning region according to the preset frequency/frequencies. The cleaning effect of the preset cleaning region is improved by controlling the cleaning robot to perform the edge patching cleaning task, and by controlling the cleaning robot to perform the edge patching cleaning task according to the preset frequency, the cleaning (Continued)

efficiency and the cleaning effect can be balanced, so the cleaning robot is more intelligent, and the user experience is better.

19 Claims, 6 Drawing Sheets

(58) Field of Classification Search
CPC ..... A47L 9/009; A47L 9/30; A47L 11/4011; A47L 11/4061; A47L 9/2852; A47L 9/2805; A47L 2201/04; G05D 1/02; G05D 1/024; B24B 17/025; B24B 19/08; B24B 19/12; Y10T 29/49293; Y10T 74/2101
See application file for complete search history.

(56) References Cited

U.S. PATENT DOCUMENTS

| | | | | |
|---|---|---|---|---|
| 7,953,526 | B2 * | 5/2011 | Durkos | G05D 1/0221 701/25 |
| 9,985,847 | B2 * | 5/2018 | Tung | G06F 11/3442 |
| 11,067,998 | B2 * | 7/2021 | Lee | B25J 9/16 |
| 11,274,929 | B1 * | 3/2022 | Afrouzi | G06T 7/30 |
| 11,348,269 | B1 * | 5/2022 | Ebrahimi Afrouzi | G01S 17/48 |
| 2011/0004342 | A1 * | 1/2011 | Knopow | G05D 1/0242 701/25 |
| 2012/0125363 | A1 | 5/2012 | Kim et al. | |
| 2020/0409376 | A1 | 12/2020 | Ebrahimi Afrouzi et al. | |
| 2022/0015596 | A1 | 1/2022 | White et al. | |

FOREIGN PATENT DOCUMENTS

| | | | |
|---|---|---|---|
| CN | 109846427 | A | 6/2019 |
| CN | 110236456 | A | 9/2019 |
| CN | 110313863 | A | 10/2019 |
| CN | 111123932 | A | 5/2020 |
| CN | 210990012 | U | 7/2020 |
| CN | 111568306 | A | 8/2020 |
| CN | 111813103 | A | 10/2020 |
| CN | 112188857 | A | 1/2021 |
| CN | 112493924 | A | 3/2021 |
| CN | 112603203 | A | 4/2021 |
| CN | 112741555 | A | 5/2021 |
| CN | 113017518 | A | 6/2021 |
| CN | 113208499 | A | 8/2021 |
| CN | 113208511 | A | 8/2021 |
| CN | 113545715 | A | 10/2021 |
| CN | 113693495 | A | 11/2021 |
| CN | 113693523 | A | 11/2021 |
| CN | 114010116 | A | 2/2022 |
| CN | 114343504 | A | 4/2022 |
| CN | 114641229 | A | 6/2022 |
| CN | 114747985 | A | 7/2022 |
| DE | 102014111217 | A1 | 2/2016 |
| WO | 2010051423 | A1 | 5/2010 |
| WO | 2022111539 | A1 | 6/2022 |
| WO | 2022117107 | A1 | 6/2022 |

OTHER PUBLICATIONS

Kabir et al., Planning algorithms for multi-setup multi-pass robotic cleaning with oscillatory moving tools, 2016, IEEE, p. 751-757 (Year: 2016).*
Bormann et al., New brooms sweep clean—an autonomous robotic cleaning assistant for professional office cleaning, 2015, IEEE, p. 4470-4477 (Year: 2015).*
Ahmadi et al., multi-robot system for continuous area sweeping tasks, 2006, IEEE, p. 1724-171729 (Year: 2006).*
International Search Report issued in corresponding International application No. PCT/CN2023/109650, mailed Nov. 20, 2023 (3 pages).
Written Opinion of the International Searching Authority for No. PCT/CN2023/109650, mailed Nov. 20, 2023 (6 pages).

* cited by examiner

METHOD, APPARATUS AND SYSTEM FOR CONTROLLING CLEANING ROBOT, AND STORAGE MEDIUM

TECHNICAL FIELD

The present disclosure relates to the technical field of cleaning, and in particular to a method, apparatus, and system for controlling a cleaning robot and a storage medium.

BACKGROUND

Cleaning robots can be used for automatically cleaning the ground, with the application scene such as indoor cleaning, large-scale place cleaning, and the like. To reduce collision damage to the cleaning robot, it is common to control the cleaning robot body at a preset distance from the wall or obstacle during the cleaning robot performing edge cleaning along a room wall or an obstacle. In addition, due to the structural design limitations of the cleaning robot body and cleaning structure, there are areas between the cleaning robot and the room wall or obstacle that cannot be cleaned by the cleaning structure of the cleaning robot when the cleaning robot performing edge cleaning along the room wall or obstacle area, that is, when the cleaning robot performs edge cleaning along the room wall or obstacle area at a preset distance, there are areas that are beyond the cleaning limits of the cleaning structure. These areas will become very dirty if they are not effectively cleaned for a long time, and the overall cleaning effect will be affected, which is not in line with the user's expectations and affects the user experience. In order to ensure the cleaning of such areas, some cleaning robots in related arts usually need to spend more time trying to clean such areas, but users are less sensitive to the dirtiness degree in such areas than to the dirtiness degree in open areas. It takes a lot of time for the cleaning robot to clean such areas, and the cleaning efficiency is not high, which affects the overall cleaning efficiency of the cleaning robot. It is still difficult to meet the user's expectations and affects the user experience. The cleaning robots in related arts cannot balance cleaning effect and cleaning efficiency, thus are still not intelligent enough.

SUMMARY

The present disclosure provides a method, device, and system for controlling a cleaning robot and a storage medium, and aims to solve the problems that cleaning robot cannot give consideration to the cleaning effect and the cleaning efficiency, and the cleaning robot is not intelligent enough.

According to a first aspect, the embodiments of the present disclosure provide a method for controlling the cleaning robot, which is configured to control the cleaning robot to perform a routine cleaning task or an edge patching cleaning task in a preset cleaning region, the method including:

determining a length of time of a current cleaning task from the most recent performed edge patching cleaning task and/or a number of performed routine cleaning tasks since the most recent performed edge patching cleaning task;

comparing the length of time and/or the number of performed routine cleaning tasks with a preset frequency;

in case the length of time and/or the number of performed routine cleaning tasks is greater than or equal to the preset frequency, determining the current cleaning task as the edge patching cleaning task, and controlling the cleaning robot to perform the edge patching cleaning task on the preset cleaning region;

in case the length of time and/or the number of performed routine cleaning tasks is less than the preset frequency, determining the current cleaning task as the routine cleaning task, and controlling the cleaning robot to perform the routine cleaning task on the preset cleaning region;

wherein the routine cleaning task includes performing edge cleaning on the preset cleaning region, and the edge patching cleaning task includes performing patching cleaning on at least part of a cleaning blind area in the edge cleaning of the routine cleaning task, and the preset frequency refers to a preset length of time or a preset number of routine cleaning tasks between two consecutive edge patching cleaning tasks performed by the cleaning robot.

According to a second aspect, the embodiments of the present disclosure provide a control apparatus for controlling the cleaning robot, and the control apparatus comprises a memory and a processor;

the memory is configured to store computer-executable instructions;

the processor is configured to execute the computer-executable instructions to implement:

the steps of the aforementioned method for controlling the cleaning robot.

According to a third aspect, the embodiments of the present disclosure provide a cleaning system, comprising:

a cleaning robot which comprises a walking unit, a mopping member, and a brushing member, the walking unit being configured to drive the cleaning robot to move, the mopping member and the brushing member being configured to clean a ground;

a base station which is at least configured to clean the mopping member of the cleaning robot; and the aforementioned control apparatus.

According to a fourth aspect, the embodiments of the present disclosure provide a computer readable storage medium, the computer readable storage medium stores computer-executable instructions, and the computer-executable instructions, when being executed by the processor, cause the processor to implement the steps of the aforementioned method.

According to a fifth aspect, the embodiments of the present disclosure provide a method for controlling the cleaning robot, which is configured to control the cleaning robot to clean a preset cleaning region, the method including:

obtaining one preset frequency or at least two preset frequencies of an edge patching cleaning task; and controlling the cleaning robot to perform an edge patching cleaning task on the preset cleaning region according to the preset frequency/frequencies.

The embodiments of the present disclosure provide a method, device, and system for controlling the cleaning robot, and a storage medium. The method includes the steps: determining a length of time of a current cleaning task from the most recent performed edge patching cleaning task and/or a number of performed routine cleaning tasks since the most recent performed edge patching cleaning task; comparing the length of time and/or the number of performed routine cleaning tasks with a preset frequency; in case the length of time and/or the number of performed routine cleaning tasks is greater than or equal to the preset frequency, determining the current cleaning task as the edge patching cleaning task, and controlling the cleaning robot to perform the edge patching cleaning task on the preset cleaning region; in case the length of time and/or the number of performed routine cleaning tasks is less than the preset frequency, determining the current cleaning task as the routine cleaning task, and controlling the cleaning robot to perform the routine cleaning task on the preset cleaning region; the routine cleaning task includes performing edge cleaning on the preset cleaning region, and the edge patching cleaning task includes performing patching cleaning on at least part of a cleaning blind area in the edge cleaning of the routine cleaning task, and the preset frequency refers to a preset length of time or a preset number of routine cleaning tasks between two consecutive edge patching cleaning tasks performed by the cleaning robot. The cleaning effect of the preset cleaning region can be improved by controlling the cleaning robot to perform the edge patching cleaning task, and by way of controlling the cleaning robot to perform the edge patching cleaning task based on the preset frequency, it can balance the cleaning efficiency and the cleaning effect, so that the cleaning robot is more intelligent, and the user experience is better.

It should be understood that the above general description and the following detailed description are merely exemplary and explanatory, and cannot limit the disclosure of the embodiments of the disclosure.

BRIEF DESCRIPTION OF THE DRAWINGS

In order to illustrate the technical solutions of the embodiments of the present disclosure more clearly, the accompanying drawings are briefly described below. The drawings described below are some of the embodiments, and it would be obvious for those skilled in the art to obtain other drawings based on these drawings without any creative efforts.

DETAILED DESCRIPTION

Figure 1:
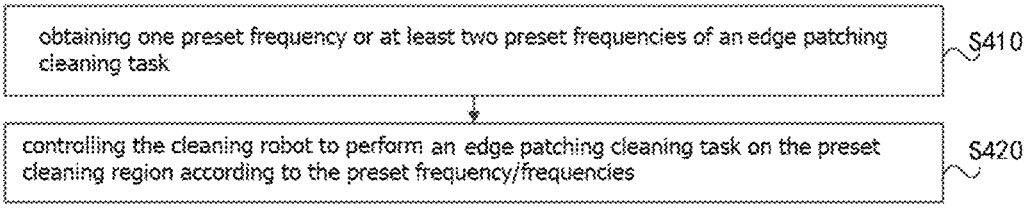
FIG. 1 is a schematic flowchart of a method for controlling a cleaning robot according to an embodiment of the disclosure.

The technical solutions in the embodiments of the disclosure are clearly and completely described below with reference to the accompanying drawings in the embodiments of the present disclosure, and obviously, the embodiments described herein are some rather than all of the embodiments of the present disclosure. Based on the embodiments in the present disclosure, all other embodiments obtained by those skill in the art without any creative efforts shall fall within the protection scope of the present disclosure.

The flowcharts shown in the drawings are merely illustrative and do not necessarily include all of the contents and operations/steps, nor do they have to be executed in the order described herewith. For example, some operations/steps may be decomposed, combined, or partially combined, so the actual execution order may be changed in the sense of an actual situation.

Some embodiments of the disclosure are described in detail below with reference to the accompanying drawings. In the case of no conflict, the following embodiments and features in the embodiments can be combined with each other.

Referring to FIG. 1, FIG. 1 is a schematic flowchart of a method for controlling a cleaning robot provided by an embodiment of the disclosure. The method for controlling the cleaning robot may be applied to a cleaning system and configured to control the cleaning robot in the system to perform cleaning tasks, to clean the areas corresponding to a cleaning task map.

The area corresponding to the cleaning task map may be any to-be-cleaned area such as a home space, a room unit of a home space, a partial area of a room unit, a large place, or a partial area of a large place. From another perspective, the area corresponding to the cleaning task map can refer to a large area cleaned for the first time, for example, the whole room unit, and can also refer to an area needing patching cleaning after the large area is cleaned for the first time, such as a near-wall area in a room unit or an obstacle area.

Figure 2:
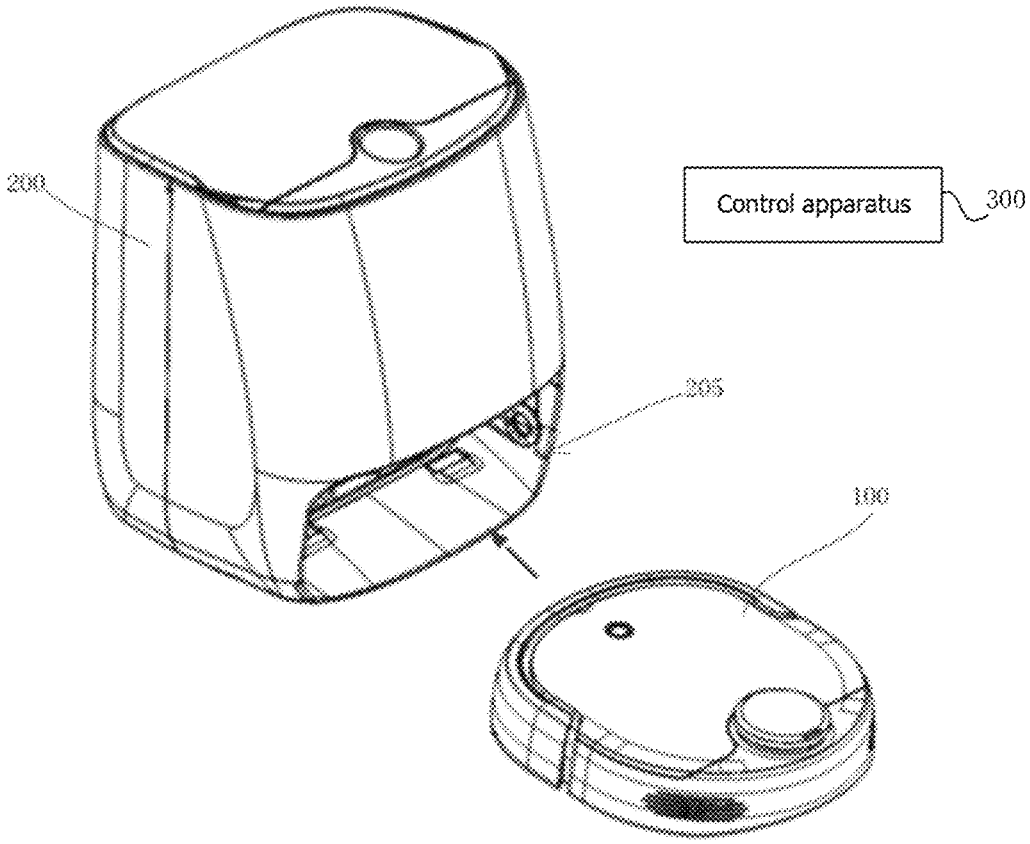
FIG. 2 is a schematic diagram of a cleaning system according to an embodiment of the disclosure.

The cleaning system includes one or more cleaning robots 100, and one or more base stations 200. As shown in FIG. 2, a base station 200 is configured to cooperate with a cleaning robot 100. For example, the base station 200 may charge the cleaning robot 100, and the base station 200 may provide a parking position and the like to the cleaning robot 100. The base station 200 may also clean a mopping member 110 of the cleaning robot 100, wherein the mopping member 110 is configured for mopping the ground.

The cleaning system further includes a control apparatus 300, and the control apparatus 300 may be configured to implement the steps of a method for controlling the cleaning robot in the embodiments of the disclosure. Optionally, the robot controller of the cleaning robot 100 and/or the base station controller of the base station 200 may be individually or cooperatively served as the control apparatus 300, to implement the steps of the method for controlling the cleaning robot in the embodiments of the disclosure. In other embodiments, the cleaning system includes a separate control apparatus 300, which is configured to implement the steps of the method for controlling the cleaning robot in the embodiment of the disclosure, the control apparatus 300 may be arranged on the cleaning robot 100 or on the base station 200. The present disclosure is certainly not limited thereto, for example, the control apparatus 300 may be a device other than the cleaning robot 100 and the base station 200, such as a home intelligent terminal, a general control apparatus, and the like.

In some embodiments, the cleaning robot 100 includes a robot body, a driving motor, a sensor unit, a robot controller, a battery, a walking unit, a robot memory, a robot communication unit, a robot interaction unit, a mopping member 110, a charging component, and the like.

Figure 3:
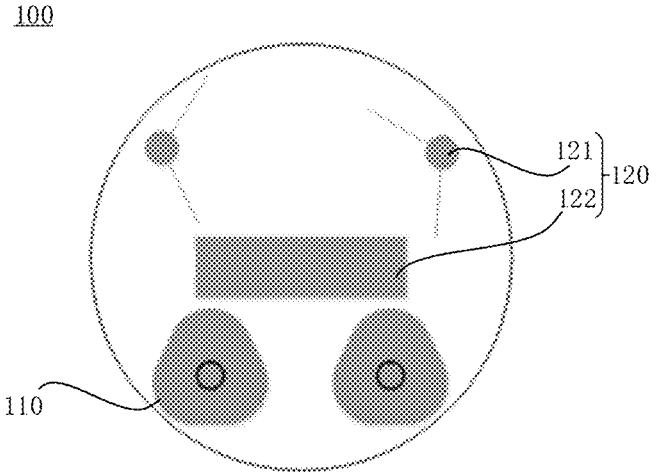
FIG. 3 is a schematic structural diagram of the cleaning robot according to an embodiment of the disclosure.

As shown in FIG. 3, the mopping member 110 is configured to mop the ground, and the number of the mopping members 110 may be one or more. The mopping member 110 is, for example, a mop. The mopping member 110 is arranged at the bottom of the robot body and specifically is arranged at the front position of the bottom of the robot body. The driving motor is arranged in the robot body, two rotating shafts extend out of the bottom of the robot body, and each one of the rotating shafts is sleeved with a mopping member 110. The driving motor can drive the rotating shaft to rotate, allowing the rotating shaft to drive the mopping member 110 to rotate.

In some embodiments, as shown in FIG. 3, the cleaning robot 100 further includes a brushing member 120, the brushing member 120 includes a side brushing member 121 and/or a middle brushing member 122. The cleaning robot 100 is a sweeping and mopping integrated cleaning robot, and the brushing member 120 and the mopping member 110 can work together. For example, the brushing member 120 and the mopping member 110 work simultaneously, or the brushing member 120 and the mopping member 110 work alternately. Of course, the brushing member 120 and the mopping member 110 can also work separately, that is, the brushing member 120 independently conducts sweeping work, or the mopping member 110 independently conducts mopping work.

In case the cleaning robot sweeps the ground through the brushing member 120, the side brushing member 121 at the outer side sweeps dirt such as dust to the middle area, and the middle brushing member 122 continues to sweep dirt in the middle area to a dust suction device. The number of the side brushing members 121 is not limited, as shown in FIG. 3, a total of two side brushing members 121 are provided and arranged on the left side and the right side of the cleaning robot 100; or, in some other embodiments, only one side brushing member 121 is provided and arranged on the left or right side.

Generally, the brushing member 120 may be disposed on the front side of the mopping member 110, so that when the brushing member 120 and the mopping member 110 work together, the cleaning robot 100 may perform mopping after sweeping for each position on the cleaning path. Compared with the brushing member 120 being disposed behind the mopping member 110, it may prevent the brushing member 120 from getting wet by the wet area mopped by the mopping member 110, and also prevent the dirt-stained brushing member 120 from contaminating the area that has already been mopped.

The walking unit is a component related to movement of the cleaning robot 100 and is configured for driving the cleaning robot 100 to move, allowing the mopping member 110 and/or the brushing member 120 to sweep and mop the ground.

The robot controller is arranged in the robot body, and the robot controller is configured for controlling the cleaning robot 100 to execute specific operation. The robot controller may be, for example, a central processing unit (CPU), or a microprocessor. For example, the robot controller is electrically connected with components such as the battery, the robot memory, the driving motor, the walking unit, the sensor unit, and the robot interaction unit so as to control the components.

The battery is arranged in the robot body, and the battery is configured for providing power to the cleaning robot 100. The robot body is further provided with a charging component, and the charging component is configured for obtaining power from an external device, so as to charge the battery of the cleaning robot 100.

The robot memory is arranged on the robot body, and computer-executable instructions are stored in the robot memory. Corresponding operation is achieved when the instructions are executed by the robot controller. A robot communication unit is arranged on the robot body, the robot communication unit is configured for enabling the cleaning robot 100 to communicate with an external device. The cleaning robot 100 may communicate with a terminal and/or communicate with the base station 200 through the robot communication unit. The base station 200 is a cleaning device configured in cooperation with the cleaning robot 100.

The sensor unit disposed on the robot body includes various types of sensors, such as laser radars, collision sensors, distance sensors, falling sensors, counters, and gyroscopes. The laser radar is arranged at the top of the robot body to obtain surrounding environment information, such as the distance and the angle of the obstacle relative to the laser radar, during the work of the laser radar. In addition, the laser radar can be replaced by a camera, the distance and the angle of the obstacle relative to the camera can be obtained by analyzing the obstacle in the image shot by the camera. The collision sensor includes a collision housing and a trigger sensor. In case the cleaning robot 100 collides with the obstacle through the collision housing, the collision housing moves towards the interior of the cleaning robot 100 and compresses an elastic buffer piece. After the collision housing moving towards the interior of the cleaning robot 100 by a certain distance, the collision housing is in contact with the trigger sensor, then the trigger sensor is triggered to generate a signal, and the signal may be sent to the robot controller in the robot body for processing. After touching the obstacle, the cleaning robot 100 moves away from the obstacle, and the collision housing is moved back to the original position under the action of the elastic buffer piece. Visibly, the collision sensor can detect the obstacle and play a role in buffering after touching the obstacle. The distance sensor may specifically be an infrared detection sensor and can be configured for detecting the distance from an obstacle to a distance sensor. The distance sensor is arranged on a side of the robot body, the distance from an obstacle near the side of the cleaning robot 100 to the distance sensor can be measured through the distance sensor. The distance sensor may also be an ultrasonic ranging sensor, a laser ranging sensor, or a depth sensor. The falling sensor is provided at the bottom edge of the robot body, and when the cleaning robot 100 moves to the edge of the ground, the falling sensor detects that the cleaning robot 100 is at risk of falling from a high place, then a corresponding falling prevention response is performed, such as stopping the movement of the cleaning robot 100, or moving in a direction away from the falling position, etc. The counter and the gyroscope are also arranged in the robot body. The counter is configured for detecting a moving distance length of the cleaning robot 100. The gyroscope is configured for detecting a rotation angle of the cleaning robot 100, to determine the orientation of the cleaning robot 100.

The robot interaction unit is arranged on the robot body, and a user can interact with the cleaning robot 100 through the robot interaction unit. The robot interaction unit includes components such as a switch button, a loudspeaker, a microphone, a touch switch/screen, and the like. A user can control the cleaning robot 100 to start working or stop working by pressing a switch button or touching switch/screen, and the working state information of the cleaning robot can be displayed through a touch screen. The cleaning robot 100 can play a prompt tone to a user through the loudspeaker, obtain a control instruction of the user through the microphone, or position the place where the user is located by obtaining the voice of the user.

It should be understood that the cleaning robot 100 described in the embodiments of the disclosure is merely a specific example, and does not specifically define the cleaning robot 100 in the embodiments of the disclosure. The cleaning robot 100 in the embodiments of the disclosure may also be other specific implementations. For example, in other implementations, the cleaning robot may have more or fewer components than the cleaning robot 100 as shown in FIG. 1.

As shown in FIG. 1, the method for controlling the cleaning robot in an embodiment of the disclosure includes step S410 to step S420.

In step S410, one preset frequency or at least two preset frequencies of an edge patching cleaning task is obtained.

In step S420, the cleaning robot is controlled to perform an edge patching cleaning task on the preset cleaning region according to the preset frequency/frequencies.

In some embodiments, one or at least two preset frequencies of the edge patching cleaning task are obtained during controlling the cleaning robot to clean a preset cleaning region, and according to the preset frequencies, the cleaning robot is controlled to perform an edge patching cleaning task on the preset cleaning region.

Illustratively, the preset cleaning region includes a room boundary and/or an obstacle contour, wherein the room boundary includes a wall, a step, a threshold, and the like, and the obstacle includes a cabinet, a bed, a sofa, a table, a chair, and the like, and of course, it is not limited to this, for example, the contour of obstacles connected to walls, steps, thresholds, etc., can also be determined as the room boundary. Illustratively, the cleaning robot may perform the edge patching cleaning on the room boundary, and also on the contour boundary of the obstacle while performing the edge patching cleaning task. The obstacle contour can be the contour of the orthographic projection of the obstacle (such as the contour of the orthographic projection of the sofa and the bed), and can also be the actual contour (such as the contour of the table leg and the chair leg) of the obstacle which may be touched by the cleaning robot when the cleaning robot moves around the obstacle.

Illustratively, the controlling the cleaning robot to perform the edge patching cleaning task according to the preset frequency includes: controlling the cleaning robot to execute a patching cleaning action during performing edge cleaning motion along the room boundary and/or the obstacle contour according to the preset frequency. The patching cleaning action includes at least one of the following: rotating by changing angular velocity, turning by changing angular velocity and linear velocity, and moving forward or backward by changing linear velocity. The edge cleaning motion is to clean the preset cleaning region while traveling at a preset distance from the room boundary or the obstacle contour.

Figure 4:
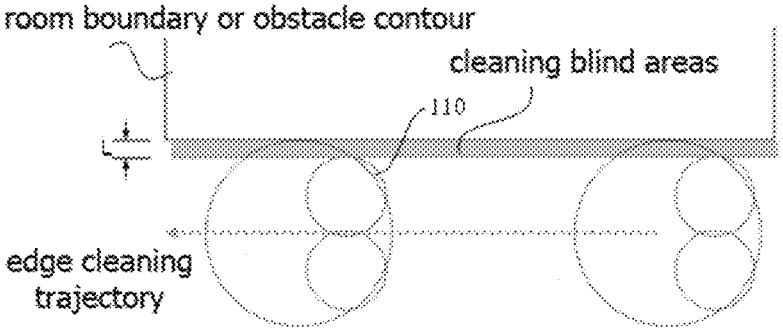
FIG. 4 is a schematic diagram of a cleaning blind area during an edge cleaning motion according to an embodiment of the disclosure.

A routine cleaning task of the cleaning robot typically includes performing edge cleaning on the preset cleaning area. Exemplarily, the edge cleaning of the routine cleaning task may be a process in which the cleaning robot cleans in a tangential direction along the room boundary and/or the obstacle contour by means of a cleaning member such as a brushing member, a mopping member, and the like. Due to the limitation of the size and the installation position of the cleaning members such as the brushing member and the mopping member, or the installation gap between the adjacent cleaning members, when the cleaning robot cleans the boundaries of a room, such as an area close to a wall, the coverage area of the mopping members is limited, and it is prone to the problem of omitting to clean an area not covered by the cleaning members. Referring to FIG. 4, FIG. 4 is a schematic diagram of the cleaning robot performing edge cleaning motion on a preset cleaning region through the mopping member 110, and the dotted line in FIG. 4 illustrates the edge cleaning trajectory of the cleaning robot, for example, edge cleaning is performed along a room boundary or an obstacle contour in the preset cleaning region, during which the cleaning robot maintains a first preset distance from the room boundary or the obstacle contour by means of a distance sensor on the side. Due to limitations in the size and mounting position of the mopping member 110, the tangent of the edge of the mopping member 110 in the edge cleaning trajectory direction is further away from the room boundary or the obstacle contour than the tangent of the edge of the cleaning robot in the edge cleaning trajectory direction, so that when the cleaning robot travels along the room boundary or the obstacle contour and cleans the area near the room boundary or the obstacle contour by the cleaning member such as the mopping member 110, the edge of the cleaning member such as the mopping member 110 keeps a second preset distance L from the room boundary or the obstacle contour, and at this time, there's a cleaning blind area (i.e., the area between the tangent of the edge of the mopping member 110 along the cleaning trajectory direction and the room boundary or the obstacle contour) because of the second preset distance L, i.e., an area not cleaned by the cleaning member, because of the preset distance. In other words, after the cleaning robot performs a routine cleaning task, there will be a cleaning blind area in the preset cleaning region that is not cleaned by the edge cleaning.

FIG. 4 shows a schematic diagram of a cleaning blind area of the cleaning robot in a working scene of linear mopping cleaning. The cleaning robot cleans along the linear room boundary or an obstacle in a linear mopping cleaning working scene. As shown in FIGS. 8-13, the working scene of the cleaning robot is not limited to including only the linear mopping cleaning, for example, the edge cleaning working scene of the cleaning robot can also include at least one of the following: sweeping cleaning along an inner corner, mopping cleaning along the inner corner, sweeping cleaning along an outer corner, mopping cleaning along the outer corner, sweeping cleaning along the cylindrical body, and mopping cleaning along the cylindrical body. Cleaning blind areas can also be generated in such scenes.

According to the embodiments of the present disclosure, the cleaning robot can be controlled to perform the edge patching cleaning task so as to clean at least part of the cleaning blind area, so that the cleaning effect of the preset cleaning region is improved, for example, the cleaning effect on the area near the room boundary and the obstacle can be at least improved.

Figure 15:
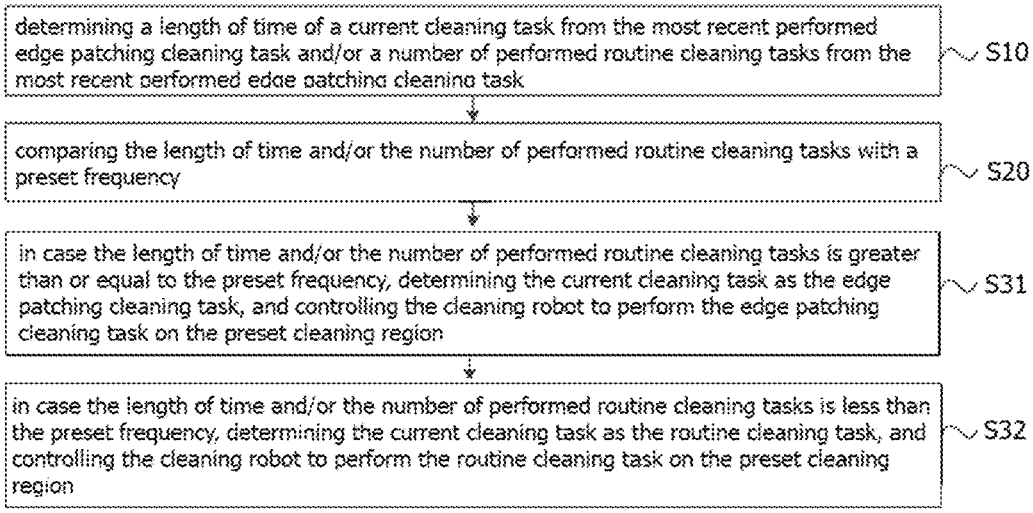
FIG. 15 is a schematic flowchart of a method for controlling the cleaning robot according to another embodiment of the disclosure.

As shown in FIG. 15, according to an embodiment, a method for controlling a cleaning robot is provided, which is configured to control the cleaning robot to perform a routine cleaning task or an edge patching cleaning task on a preset cleaning region, and the method includes the steps S10 to S32.

In step S10, a length of time of a current cleaning task from the most recent performed edge patching cleaning task and/or a number of performed routine cleaning tasks since the most recent performed edge patching cleaning task is determined.

In step S20, the length of time and/or the number of performed routine cleaning tasks is compared with a preset frequency.

In step S31, in case the length of time and/or the number of performed routine cleaning tasks is greater than or equal to the preset frequency, the current cleaning task is determined as the edge patching cleaning task, and the cleaning robot is controlled to perform the edge patching cleaning task on the preset cleaning region.

In step S32, in case the length of time and/or the number of performed routine cleaning tasks is less than the preset frequency, the current cleaning task is determined as the routine cleaning task, and the cleaning robot is controlled to perform the routine cleaning task on the preset cleaning region.

The routine cleaning task includes performing edge cleaning on the preset cleaning region, and the edge patching cleaning task includes performing patching cleaning on at least part of a cleaning blind area in the edge cleaning of the routine cleaning task, and the preset frequency refers to a preset length of time or a preset number of routine cleaning tasks between two consecutive edge patching cleaning tasks performed by the cleaning robot.

In some embodiments, the step S31 includes:

in case the length of time is greater than or equal to the preset length of time or the number of performed routine cleaning tasks is greater than or equal to the preset number of routine cleaning tasks, determining the current cleaning task as the edge patching cleaning task, and controlling the cleaning robot to perform the edge patching cleaning task on the preset cleaning region; or in case the number of performed routine cleaning tasks is greater than or equal to the preset number of routine cleaning tasks, comparing the length of time and the preset length of time, in case the length of time is greater than or equal to the preset length of time, determining the current cleaning task as the edge patching cleaning task, and controlling the cleaning robot to perform the edge patching cleaning task on the preset cleaning region.

In some embodiments, the controlling the cleaning robot to perform the edge patching cleaning task according to the preset frequency may include controlling the cleaning robot to perform the edge patching cleaning task once for every preset length of time, for example, once for every seven days; and the controlling the cleaning robot to perform the edge patching cleaning task according to the preset frequency may also include controlling the cleaning robot to perform the edge patching cleaning task once after that preset number of times of the routine cleaning task have been performed on the preset region such as the room. For example, a certain room has been cleaned for seven times of routine cleaning tasks, the edge patching cleaning is required for the 8th cleaning (i.e., the 8th time an edge patching cleaning task is performed on the room).

In some embodiments, after determining that the cleaning robot has performed a preset number of routine cleaning tasks on the room, it is further determined whether a time interval from the last edge patching cleaning task is greater than or equal to seven days, and if so, the cleaning robot is controlled to perform an edge patching cleaning task. Understandably, there may be a situation in which the cleaning robot performs an edge patching cleaning task on the room one day ago and performs seven routine cleaning tasks on the room within one day, and at the time of cleaning for the 8th time, although seven routine cleaning tasks have been performed since the last performed edge patching cleaning task, it is only one day since the last performed edge patching cleaning task, and the cleaning blind areas at the room boundary accumulate only a limited amount of dirt within one day, and there is no need to perform a patching cleaning right away. In this way, the efficiency of the cleaning robot can be balanced to prevent the accumulation of dirt at room boundaries that have not been cleaned for a long period of time.

It will be understandable that the preset frequency may be a user-defined setting, a default setting of the cleaning robot, or a setting of the cleaning robot based on analyzing the cleaning habits of the user. The cleaning robot may determine only a length of time between two consecutive edge patching cleaning tasks and determine whether to perform the edge patching cleaning task based on the preset length of time. The cleaning robot may also determine only a number of performed routine cleaning tasks between two consecutive edge patching cleaning tasks and determine whether to perform the edge patching cleaning task based on the preset number of routine cleaning tasks. The cleaning robot may also determine the length of time and the number of performed routine cleaning tasks between the two consecutive edge patching cleaning tasks, for example, it may be that the current cleaning task is determined to be the edge patching cleaning task if either the length of time or the number of performed routine cleaning tasks is greater than or equal to a preset frequency (i.e., either the length of time is greater than or equal to the preset length of time and the number of performed routine cleaning tasks is greater than or equal to the number of preset routine cleaning tasks is satisfied), and it may also be that the current cleaning task is determined to be the edge patching cleaning task when the length of time is further determined to be greater than or equal to the preset length of time on the basis of the number of performed routine cleaning tasks being greater than or equal to the preset number of routine cleaning tasks.

Due to the fact that the edge patching cleaning task requires additional time and power to perform patching cleaning on at least part of the cleaning blind areas of the edge cleaning in a routine cleaning task, and the user is less sensitive to dirt on the room boundary or the obstacle contour, it is not necessary to control the cleaning robot to perform the edge patching cleaning task every time the preset cleaning region is cleaned in order to improve the cleaning efficiency. By controlling the cleaning robot to perform the edge patching cleaning task according to a preset frequency to clean the preset cleaning region, the embodiments of the present application reduce or eliminate the dirt near the room boundary or the obstacle contour, which can balance the cleaning efficiency and the cleaning effect, and the cleaning robot is more intelligent and the user experience is better. By way of example, the preset frequency of the edge patching cleaning task may be lower than the frequency of only performing edge cleaning motion (i.e., regular cleaning task).

In some embodiments, controlling the cleaning robot to perform the routine cleaning task on the preset cleaning region, includes: controlling the cleaning robot to perform edge cleaning motion and/or global cleaning motion on the preset cleaning region.

For example, generally speaking, the cleaning robot may perform global cleaning motion on the preset cleaning region in addition to performing the edge cleaning motion on the preset cleaning region to achieve more comprehensive cleaning effects. The global cleaning motion means that the cleaning robot carries out cleaning planning for the entire range of the preset cleaning region, and covers the preset cleaning region with cleaning according to the planned cleaning path. The cleaning path of the global cleaning motion may be any cleaning path capable of performing coverage cleaning of the preset cleaning region, including, but not limited to, a boustrophedon path, a spiral path, a Z-shaped path, a Y-shaped path, a random path, and the like.

In some embodiments, controlling the cleaning robot to perform the edge patching cleaning task on the preset cleaning region, includes:

controlling the cleaning robot to perform patching cleaning action based on edge cleaning motion while performing the edge cleaning motion on the preset cleaning region; and/or controlling the cleaning robot to perform the patching cleaning action based on global cleaning motion while performing the global cleaning motion on the preset cleaning region.

For example, the edge patching cleaning task adds a patching cleaning action based on the routine cleaning task to patch clean the cleaning blind area of the edge cleaning in the routine cleaning task.

Figure 5:
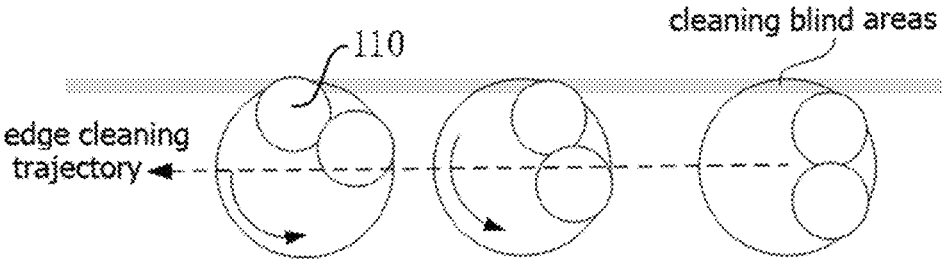
FIG. 5 and FIG. 6 are schematic diagrams of the cleaning robot performing an edge patching cleaning task according to some embodiments of the disclosure.

For example, the edge patching cleaning task may perform a patching cleaning action based on the edge cleaning motion in the routine cleaning task. FIG. 5 shows a schematic diagram of performing an edge patching cleaning task by the cleaning robot according to an embodiment. During the edge cleaning motion in a straight line, the cleaning robot rotates clockwise or counterclockwise by a preset angle or an arbitrary angle every time it travels a certain distance, so that the edge of the cleaning member such as the mopping member 110 is closer to the room boundary or the obstacle contour, which enlarges the moving trajectory of the mopping member 110 and increases the coverage area of the mopping member 110 to clean at least some of the cleaning blind areas, thus improving the cleaning effect on the room boundary and the like. Optionally, the angle of rotation of the cleaning robot during the patching cleaning action may be determined based on the size of the cleaning robot, the size of the cleaning member, and the mounting position of the cleaning member on the cleaning robot, as long as it is satisfied that it is possible to cover at least a portion of the cleaning blind area of the cleaning member with the cleaning range of the cleaning member during the rotation.

For example, the edge patching cleaning task may perform a patching cleaning action based on the global cleaning motion in the routine cleaning task. Controlling the cleaning robot to perform the patching cleaning action based on global cleaning motion while performing the global cleaning motion on the preset cleaning region, includes: controlling the cleaning robot to perform the global cleaning motion on the preset cleaning region and, when the cleaning robot travels in the vicinity of the room boundary and/or the obstacle contour, to continue to travel a preset distance toward the room boundary and/or the obstacle contour before performing a turning motion, so that a coverage of a cleaning member of the cleaning robot covers at least a portion of the cleaning blind area.

Figure 6:
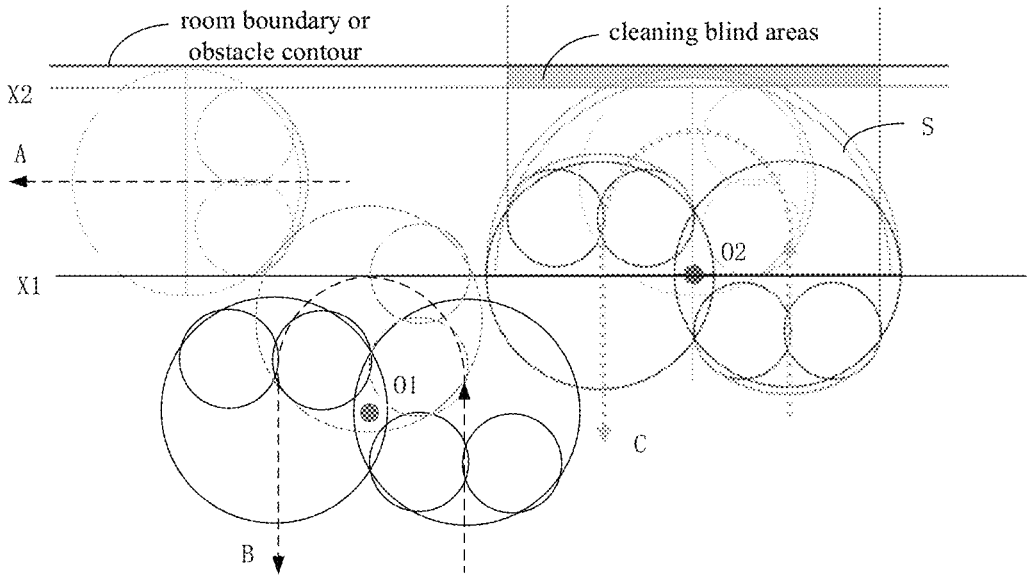

For ease of exposition, the following will be described as an example where the cleaning path of the global cleaning motion is a boustrophedon path. FIG. 6 shows a schematic diagram of a cleaning robot performing an edge patching cleaning task according to another embodiment. The preset cleaning region includes a room boundary or an obstacle contour, and the controlling the cleaning robot to perform the edge patching cleaning task includes controlling the cleaning robot to perform boustrophedon cleaning motion on the preset cleaning region, and when the cleaning robot travels in the vicinity of the room boundary and/or the obstacle contour along a straight line, continue to travel a preset distance toward the room boundary and/or the obstacle contour before executing a U-turn action, to allow the coverage range of the cleaning member of the cleaning robot covers at least part of the cleaning blind area. The cleaning blind area is an area between a boundary line of the coverage range of the cleaning member and the room boundary and/or the obstacle contour during the cleaning robot performing the edge cleaning motion. Illustratively, whether the cleaning robot has traveled to the vicinity of a room boundary or a obstacle contour can be determined by determining whether the distance between the cleaning robot and the contour of the room boundary or the obstacle reaches a distance threshold during the cleaning robot moving along the straight line. As shown in FIG. 6, the dotted line A represents a trajectory of the cleaning robot performing an edge cleaning motion, the dotted line B represents a trajectory of the cleaning robot performing a boustrophedon cleaning motion, and the dotted line C represents a trajectory of the cleaning robot performing an edge patching cleaning task in which the cleaning robot performs a boustrophedon cleaning motion and performs a patching cleaning action based on the boustrophedon cleaning motion. The cleaning member may cover the area between tangents X1 and X2 of the cleaning member in the direction of the trajectory A during the execution of the edge cleaning motion by the cleaning robot along the trajectory A. Therefore, the boustrophedon cleaning motion in the routine cleaning task is usually executed along the trajectory B, i.e., the cleaning robot does not travel to the position immediately adjacent to the room boundary or the obstacle contour before it makes a U-turn, but rather when it travels to the O1 position (there's still some distance from the room boundary or the obstacle contour) near the room boundary or the obstacle contour, it makes the U-turn, as long as in the process the coverage of the cleaning members can be partially covered to the area between X1 and X2, so as to ensure the cleaning efficiency of the cleaning robot. When it is necessary to perform patching cleaning on the preset cleaning region, the cleaning robot can be controlled to continue to travel a preset distance toward the room boundary or the obstacle contour to reach the O2 position when it reaches the position corresponding to O1 in the boustrophedon cleaning motion, then perform a U-turning action as well as continue the boustrophedon cleaning motion. The arc S in FIG. 6 shows the trajectory of the edge of the cleaning member during the U-turning process of the cleaning robot at the O2 position, and it can be seen that the coverage of the cleaning member partially overlaps with the cleaning blind area, so that at least a part of the cleaning blind area can be patch cleaned. The cleaning robot approaches the room boundary or the obstacle contour along a boustrophedon track, when the cleaning robot reach the O2 position, it has a distance from the room boundary or the obstacle contour equal to a distance threshold or collides with the room boundary or the obstacle, at this time, the cleaning robot performs an anticlockwise U-turning and, during the U-turning, the edge of the cleaning member such as the mopping part 110 is closer to the room boundary or the obstacle contour so as to clean at least part of the cleaning blind area. In some embodiments, the U-turning action is not limited to anticlockwise U-turning, but can also be a clockwise U-turning. Illustratively, the distance threshold can be determined according to the radius of the cleaning robot, the cleaning range of the cleaning member such as the mopping member 110.

Optionally, for the edge patching cleaning task of the room boundary, it is possible to control the cleaning robot to perform the edge cleaning motion along the room boundary and perform the patching cleaning action when cleaning each room, and then control the cleaning robot to perform the boustrophedon cleaning motion along the boustrophedon path; it is also possible to perform the boustrophedon cleaning motion for all rooms and then perform the edge cleaning motion along the room boundary and perform the patching cleaning action; it is still also possible to control the cleaning robot to continue to travel a preset distance toward the room boundary and/or the obstacle contour before performing a U-turning action when it travels in a straight line to the vicinity of the room boundary and/or the obstacle contour, that is, to control the cleaning robot to perform the U-turning action in the boustrophedon motion when it's distance from the room boundary reaches the distance threshold or collision with the room boundary occurs during the boustrophedon cleaning motion of the room being performed, in which the mopping member at the end of the robot can mop at least part of the cleaning blind area near the room boundary without an extra edge cleaning motion. The present disclosure is certainly not limited thereto.

Illustratively, before the cleaning robot is controlled to perform boustrophedon cleaning motion on the preset cleaning region, the method further includes: controlling the cleaning robot to conduct edge cleaning motion on the preset cleaning region. The room boundary and/or the obstacle contour in the preset cleaning region can be determined by way of the edge cleaning motion. For example, as shown in FIG. 6, where the edge patching cleaning is performed by performing a U-turning after the cleaning robot continue to travel a preset distance toward the room boundary and/or the obstacle contour during the boustrophedon cleaning motion, after one time of edge cleaning motion in the room (no patching cleaning is performed during the edge cleaning motion), during the boustrophedon cleaning motion, it is possible to control the cleaning robot to continue to travel a preset distance toward the room boundary and/or the obstacle contour before performing a U-turning action when the cleaning robot travels in a straight line to the vicinity of the room boundary and/or the obstacle contour, that is, to control the cleaning robot to perform the U-turning action when the distance from the room boundary reaches the distance threshold or when collision with the room boundary occurs, to clean at least part of the cleaning blind area. The area covered by the boustrophedon cleaning motion with the addition of a patching cleaning action does not deduct the area covered by the completed edge cleaning motion, that is, when the cleaning robot travels along the boustrophedon trajectory to the vicinity of the room boundary and/or the obstacle contour, it continue to travel a preset distance toward the room boundary and/or the obstacle contour before performing a U-turning action, that is, when the distance between the cleaning robot and the room boundary or the obstacle contour is equal to the distance threshold or the cleaning robot collides with the room boundary or the obstacle, the cleaning robot performs a counterclockwise or clockwise U-turning to clean at least part of the cleaning blind area. It is also possible to control the cleaning robot to perform two boustrophedon cleaning motions with orthogonal boustrophedon trajectories to ensure that most or all of the missed areas, i.e., the cleaning blind areas, can be patching cleaned once.

In some embodiments, the method further includes: obtaining an object type of an edge patching cleaning object; and controlling, according to the preset frequency, the cleaning robot to perform the edge patching cleaning task on the preset cleaning region, includes: determining a preset frequency corresponding to the object type of the edge patching cleaning object, and controlling the cleaning robot to perform the edge patching cleaning task on the preset cleaning region according to the preset frequency corresponding to the object type. The controlling the cleaning robot to perform the edge patching cleaning task on the preset cleaning region includes controlling the cleaning robot to perform the edge patching cleaning on the edge patching cleaning object, i.e., to clean at least part of the cleaning blind area near the edge patching cleaning object. It should be understood that each object type corresponds to a preset frequency, one edge patching cleaning object corresponds to at least one object type. In case one edge patching cleaning object only corresponds to one object type, the edge patching cleaning object only corresponds to one preset frequency; in case one edge patching cleaning object corresponds to at least two object types, the edge patching cleaning object correspondingly corresponds to at least two preset frequencies, and edge patching cleaning may be carried out on the edge patching cleaning object according to the at least two different preset frequencies. For example, one tea table, has one pair of side edges belonging to one object type, and another pair of side edges belonging to another object type, then the cleaning robot can perform edge patching cleaning on the two pairs of side edges according to different frequencies. By determining the preset frequency based on the object type of the edge patching cleaning object, the cleaning efficiency of the cleaning robot and the cleaning effect of the preset cleaning region can be balanced.

Illustratively, the preset frequency includes a first preset frequency and a second preset frequency, and the object type includes a suspended obstacle and a non-suspended obstacle.

The suspended obstacle is radar invisible (not observable by radar), but can trigger a change in the output signal of the collision sensor on the radar, that is, the suspended obstacle is an obstacle that can be detected by the collision sensor on the radar, such as a bookcase with a low space at the bottom, a tea table, a sofa, and the like. For example, the edge of the bottom of the sofa detected by the collision sensor on the radar can be determined as the suspended obstacle.

Illustratively, in case the cleaning robot cleans along the suspended obstacle, it can clean the ground along the outer contour of the orthographic projection of the obstacle, while the area near the outer contour of the obstacle is not cleaned. By controlling the cleaning robot to perform edge patching cleaning along the suspended obstacle, the cleaning blind area near the outer contour of the suspended obstacle can be reduced or eliminated. The cleaning robot performing the edge patching cleaning along the suspended obstacle includes a patching cleaning operation while the cleaning robot performs a ground cleaning along the outer contour of the orthographic projection of the obstacle, for example, based on the output signal of the collision sensor on the radar, the cleaning range under the suspended obstacle is determined, or the cleaning blind area near the outer contour of the suspended obstacle is determined by the fusion of visual signals from the vision sensor; then the cleaning robot is controlled to clean the determined range.

Illustratively, the non-suspended obstacle is an obstacle that the radar can observe and may collide with a main body of the cleaning robot, such as a box-type bed or the like.

Illustratively, the controlling the cleaning robot to perform the edge patching cleaning task on the preset cleaning region according to the preset frequency corresponding to the object type includes: in case it is determined that the edge patching cleaning object is the suspended obstacle, controlling the cleaning robot to perform edge patching cleaning along the suspended obstacle according to the first preset frequency; and in case it is determined that the edge patching cleaning object is a non-suspended obstacle, controlling the cleaning robot to perform the edge patching cleaning task on the non-suspended obstacle according to the second preset frequency. The second preset frequency is different from the first preset frequency.

Optionally, the first preset frequency is higher than the second preset frequency. Dirt near suspended obstacle such as the edge of the bottom of the sofa is more noticeable than dirt near the non-suspended obstacle, and by cleaning dirt near the suspended obstacle at a relatively higher frequency, a better cleaning effect can be obtained; by cleaning dirt near the non-suspended obstacle at a relatively lower frequency, cleaning efficiency can be improved.

Illustratively, the preset frequency includes a third preset frequency and a fourth preset frequency, and the object type includes a discrete obstacle and an aggregated obstacle.

The discrete obstacle means an edge patching cleaning object with a relatively dispersed obstacle distribution, such as a cardboard box in the living room without any other items around. The aggregated obstacle means a relatively concentrated distribution of edge patching cleaning objects, such as table legs/chair legs of the dining tables/chairs gathered together in the kitchen. The present disclosure is certainly not limited thereto.

Illustratively, the controlling the cleaning robot to perform the edge patching cleaning task on the preset cleaning region according to the preset frequency corresponding to the object type includes: in case determining that the edge patching cleaning object is the discrete obstacle, controlling the cleaning robot to perform edge patching cleaning along the discrete obstacle according to the third preset frequency; in case determining that the edge patching cleaning object is an aggregated obstacle, controlling the cleaning robot to perform the edge patching cleaning task on the aggregated obstacle according to the fourth preset frequency. The third preset frequency is different from the fourth preset frequency.

Optionally, the third preset frequency is higher than the fourth preset frequency. Since users may be more sensitive to the cleaning blind area near the discrete obstacle, a better cleaning effect can be obtained by performing the edge patching cleaning on the discrete obstacle at a higher frequency; and the aggregated obstacle is cleaned at a lower frequency, so that the cleaning efficiency can be improved.

Illustratively, the edge patching cleaning object corresponds to at least two object types, and one object type corresponds to one preset frequency. For example, the edge patching cleaning object can correspond to both the suspended obstacle and discrete obstacle, the suspended obstacle corresponds to the first preset frequency, and the discrete obstacle corresponds to the third preset frequency, then the edge patching cleaning object corresponds to both the first preset frequency and the third preset frequency. The controlling the cleaning robot to perform the edge patching cleaning task on the preset cleaning region according to the preset frequency corresponding to the object type includes: performing the edge patching cleaning on the preset cleaning region according to the highest preset frequency in the preset frequencies corresponding to the at least two object types. For example, in case an edge patching cleaning object corresponds to both the suspended obstacle and the discrete obstacle, the cleaning robot is controlled to perform the edge patching cleaning task on the edge patching cleaning object according to the higher preset frequency of the first preset frequency and the third preset frequency. That is, a more suitable frequency is chose to perform the edge patching cleaning task, which on the one hand ensures the overall cleaning effect of the room, and on the other hand ensures the overall cleaning efficiency of the room, thus the user experience is better.

In some embodiments, the method further includes: obtaining an environment type of an area where an edge patching cleaning object is located; and the controlling, according to the preset frequency, the cleaning robot to perform the edge patching cleaning task on the preset cleaning region includes: controlling the cleaning robot to perform the edge patching cleaning task on the preset cleaning region according to a preset frequency corresponding to the environment type. Illustratively, the environment type includes, but is not limited to, at least one of a common region, a non-common region type, a narrow region, and a non-narrow region.

Illustratively, the preset frequency includes a fifth preset frequency and a sixth preset frequency, and the environment type of the area where the edge patching cleaning object is located includes a public area and a non-public area.

The public area may include areas shared by members, such as a living room, a restaurant, a kitchen, a balcony, a walkway, and the like, and the non-public area includes areas with relatively strong privacy, such as a bedroom and a book room. The cleaning robot may automatically identify whether the room is a public area or a non-public area, for example, according to the furniture type. Users can also set the room as a public area or a non-public area.

Illustratively, the controlling the cleaning robot to perform the edge patching cleaning task on the preset cleaning region according to the preset frequency corresponding to the environment type includes: in case determining that the environment type of the area where the edge patching cleaning object is located is the public area, controlling the cleaning robot to perform the edge patching cleaning task on the room boundary of the public area and/or the obstacle contour of the public area according to the fifth preset frequency; in case determining that the environment type of the area where the edge patching cleaning object is located is the non-public area, controlling the cleaning robot to perform the edge patching cleaning task on the room boundary of the non-public area and/or the obstacle contour of the non-public area according to the sixth preset frequency. The sixth preset frequency is different from the fifth preset frequency.

Optionally, the fifth preset frequency is higher than the sixth preset frequency. According to the method, the edge patching cleaning task is performed at a higher frequency for common areas that tend to get dirty, so that a better cleaning effect can be obtained; and the non-common area is cleaned at a lower frequency, so that the cleaning efficiency can be improved.

Illustratively, the preset frequency includes a seventh preset frequency and an eighth preset frequency, and the environment type of the area where the edge patching cleaning object is located includes a narrow area and a non-narrow area.

Figure 7:
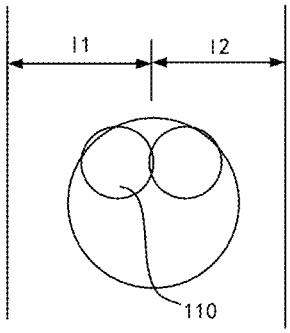
FIG. 7 is a schematic diagram of a narrow region according to an embodiment of the disclosure.

Referring to FIG. 7, during the cleaning robot traveling in a preset area, the sum of the distances of the cleaning robot from the obstacles and/or room boundaries on the left and right sides of the cleaning robot is smaller than or equal to a preset value L0, i.e., l1+l2 is smaller than or equal to L0, it is determined that the preset area is a narrow area; and when the sum of the distances of the cleaning robot from the obstacles and/or room boundaries on the left and right sides of the cleaning robot is larger than the preset value, the preset area is determined to be a non-narrow area. It should be understood that the whole preset cleaning region needing to be cleaned by the cleaning robot is the narrow area or the non-narrow area, or some of the whole preset cleaning regions needing to be cleaned by the cleaning robot are the narrow areas, and some areas are non-narrow areas.

Illustratively, the controlling the cleaning robot to perform the edge patching cleaning task on the preset cleaning region according to the preset frequency corresponding to the environment type includes: in case determining that the environment type of an area where the edge patching cleaning object is located is the narrow area, controlling the cleaning robot to perform the edge patching cleaning task on the room boundary of the narrow area and/or the obstacle contour of the narrow area according to the seventh preset frequency; in case determining that the environment type of an area where the edge patching cleaning object is located is the non-narrow area, controlling the cleaning robot to perform the edge patching cleaning task on the room boundary of the non-narrow area and/or the obstacle contour of the non-narrow area according to the eighth preset frequency. The eighth preset frequency is different from the seventh preset frequency.

Optionally, the seventh preset frequency is higher than the eighth preset frequency, that is, the boundary cleaning frequency for the narrow area is higher than the boundary cleaning frequency for the non-narrow area. Since users are more sensitive to the dirt on the cleaning blind area near the obstacle and/or the room boundary in the narrow area, dirt in the narrow area is cleaned at a higher frequency, then a better cleaning effect can be achieved; and dirt in the non-narrow area is cleaned at a lower frequency, so that the cleaning efficiency can be improved.

Illustratively, the area where the edge patching cleaning object is located corresponds to at least two environment types, and each environment type corresponds to a preset frequency, that is, the area where the edge patching cleaning object is located corresponds to at least two preset frequencies. Illustratively, the fifth preset frequency, the sixth preset frequency, the seventh preset frequency, and the eighth preset frequency are different. Illustratively, the environment type of the area where the edge patching cleaning object is located may be both a common area and a narrow area.

Illustratively, the controlling the cleaning robot to perform the edge patching cleaning task according to the preset frequency corresponding to the environment type includes: controlling the cleaning robot to perform the edge patching cleaning tasks on the edge patching cleaning object of the preset cleaning region according to the highest preset frequency of the preset frequencies corresponding to the at least two environment types. For example, when the environment type of the area where the edge patching cleaning object is located is both a common area and a narrow area, the cleaning robot is controlled to perform the edge patching cleaning task on the edge patching cleaning object of the preset cleaning region according to the higher preset frequency in the fifth preset frequency and the seventh preset frequency, so as to select a more appropriate frequency to perform the edge patching cleaning task, on the one hand, the overall cleaning effect of the room is ensured, and on the other hand, the overall cleaning efficiency of the room is also guaranteed, thus the user experience is better.

In some embodiments, the control method may include: obtaining an object type of an edge patching cleaning object; and obtaining an environment type of a region where the edge patching cleaning object is located. The controlling the cleaning robot to perform the edge patching cleaning task on the preset cleaning region according to the preset frequency includes: determining a preset frequency corresponding to the object type of the edge patching cleaning object; determining a preset frequency corresponding to the environment type of the area where the edge patching cleaning object in located; and controlling the cleaning robot to perform the edge patching cleaning task on the preset cleaning region according to the higher preset frequency of the preset frequencies corresponding to the object type and the environment type.

Illustratively, in case the edge patching cleaning object corresponds to a plurality of object types and/or environment types, the cleaning robot is controlled to perform the edge patching cleaning task on the edge patching cleaning object according to the highest preset frequency in the preset frequencies corresponding to the plurality of object types and/or the environment types. Illustratively, the first preset frequency, the second preset frequency, the third preset frequency, the fourth preset frequency, the fifth preset frequency, the sixth preset frequency, the seventh preset frequency, and the eighth preset frequency are different. In case the preset cleaning region is a narrow area, and the narrow area includes both a suspended obstacle and a non-suspended obstacle, then an edge patching cleaning task can be performed on the suspended obstacle in the narrow area according to the higher preset frequency in the first preset frequency and the seventh preset frequency, and an edge patching cleaning task can be performed on the non-suspended obstacle in the narrow area according to the higher preset frequency in the second preset frequency and the seventh preset frequency. In case the preset cleaning region is a narrow area in a non-common area, and the narrow area includes both a suspended obstacle and a non-suspended obstacle, then an edge patching cleaning task can be performed on the suspended obstacle in the narrow area according to the highest preset frequency in the first preset frequency, the sixth preset frequency, and the seventh preset frequency, and an edge patching cleaning task can be performed on the non-suspended obstacle in the narrow area according to the highest preset frequency in the second preset frequency, the sixth preset frequency, and the seventh preset frequency. Illustratively, the preset frequency of the edge patching cleaning task of the edge patching cleaning object can be determined according to various types of the edge patching cleaning object in the room, and the edge patching cleaning task is performed on each of the edge patching cleaning objects according to the determined preset frequency. For different types of edge patching cleaning objects in the same room, a more appropriate frequency is selected for each of the edge patching cleaning objects to perform the edge patching cleaning task, which on the one hand ensures the overall cleaning effect of the room, and on the other hand ensures the overall cleaning efficiency of the room, thus the user experience is better.

In some embodiments, the method further includes: obtaining a working scene of the cleaning robot, wherein the working scene includes at least one of sweeping cleaning along an inner corner, mopping cleaning along the inner corner, sweeping cleaning along an outer corner, mopping cleaning along the outer corner, sweeping cleaning along the cylindrical body, mopping cleaning along the cylindrical body, and mopping cleaning along a straight line. Illustratively, the controlling the cleaning robot to perform the edge patching cleaning task includes: selecting a corresponding edge patching cleaning strategy according to the working scene of the cleaning robot; and controlling the cleaning robot to perform the edge patching cleaning task according to the edge patching cleaning strategy. The edge patching cleaning strategy is to control the cleaning robot to perform the patching cleaning action so as to achieve edge patching cleaning on the patching cleaning object. The edge patching cleaning strategy includes a rotating strategy, a retreating cleaning strategy, and a tangential cleaning strategy. According to the disclosure, corresponding edge patching cleaning strategy is selected according to the working scene of the cleaning robot, so that the cleaning is more targeted, the cleaning effect and/or the cleaning efficiency are better, and the intelligent degree is higher.

Figure 8:
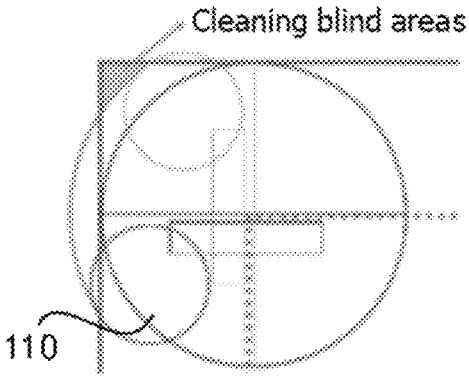
FIG. 8 to FIG. 10 are schematic diagrams of the cleaning robot performing an edge patching cleaning task according to another embodiment of the disclosure.

Illustratively, as shown in FIG. 8, the cleaning robot cleans along the inner corner of the room boundary or the obstacle (the inner corner can be greater than 0 degree and less than 180 degrees, the illustration shows a right angle of 90 degrees). During the cleaning by the brushing member along the inner corner, the cleaning robot may rotate according to the rotating cleaning strategy to bring a gas outlet of a fan close to the inner corner, so that the airflow from the gas outlet can lift the dirt from the inner corner, which can then be cleaned by the brushing member. Illustratively, the gas outlet of the fan is arranged at the rear of the right side of the cleaning robot, the right side of the cleaning robot cleans along the room boundary or the obstacle contour, while cleaning the inner corner, the cleaning robot is controlled to rotate counterclockwise in place, so that the airflow from the gas outlet blows towards the inner corner, lifting the dirt from the inner corner towards the front of the cleaning robot, and allowing the cleaning robot to sweep and suck the dirt through the brushing member and the dust suction device of the cleaning robot. The cleaning robot can be controlled to travel along the first side of the inner corner according to the rotary cleaning strategy during the mopping member mopping cleaning along the inner corner, and rotate in place when advancing to the inner corner and abutting against the second side of the inner corner to mopping at least part of the area of the inner corner, and then the cleaning robot travels along the second side of the inner corner.

Figure 9:
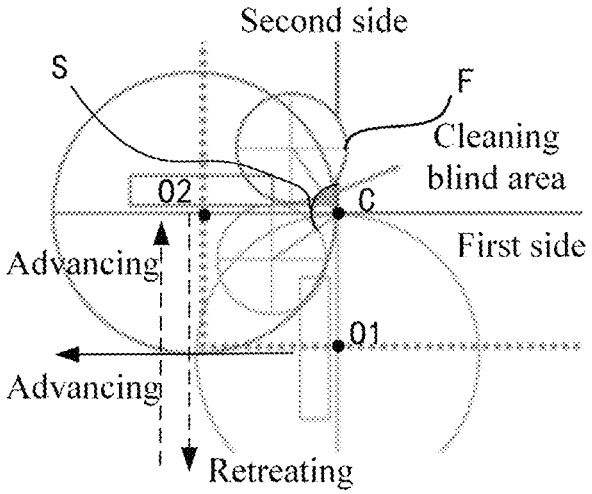
Figure 10:
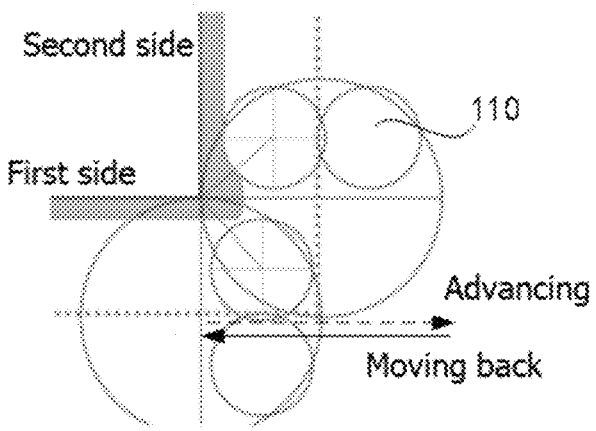

Illustratively, as shown in FIG. 9 and FIG. 10, the cleaning robot cleans along a room boundary or an outer corner of the obstacle (the outer corner can be greater than 180 degrees, and 270 degrees is shown).

Referring to FIG. 9, Circle F indicates a cleaning range of the cleaning member, and when the cleaning member is a side brush, the bristles of the side brush are able to clean the reachable range within circle F during rotation. In a routine cleaning task, when edge cleaning of the outer corner shown in FIG. 9 is needed, the cleaning robot is usually controlled to travel along the first side of the outer corner to the position O1, then rotate clockwise around the junction point C between the first side and the second side of the outer corner, and then continue to clean along the second side of the outer corner. During this process, the bristles of the side brush cannot clean the area between the arc S and the boundary of the outer corner (the cleaning blind area). An optional edge patching cleaning strategy is a retreating cleaning strategy, for example, after the cleaning robot turns from the first side of the outer corner (e.g., right turn) to the second side of the outer corner (i.e., rotate clockwise around the junction point C), the cleaning robot is controlled to retreat a preset distance before advancing (shown by the dotted arrow), allowing the cleaning range of the sweeping member to cover, during the retreating process of the cleaning robot, the missed area during the turn (i.e., the area between the arc S and the boundary of the outer corner, which cannot be covered by the cleaning range of the brushing member while the cleaning robot is rotating around the point C). Another optional edge patching strategy is rotating patching, for example, before the cleaning robot turns from the first side of the outer corner to the second side of the outer corner (e.g., right turn), the cleaning robot at the corner of the out corner is first controlled to travel a preset distance (shown by the solid arrow) in the direction extending from the first side of the outer corner, and the preset distance may be equal to or greater than the radius of the cleaning robot; the cleaning robot is then controlled to rotate in place (e.g., around a point between the travel wheels), and then controlled to travel along the second side of the outer corner so that the brushing member can be abutted the second side of the outer corner, and the upper portion of the cleaning blind area in FIG. 9 can be cleaned during this process.

Referring to FIG. 10, when mopping cleaning along the outer corner through the mopping member, an optional edge patching cleaning strategy is a retreating cleaning strategy, such as controlling the cleaning robot to advance a preset distance and then retreat a preset distance before turning from the first side of the outer corner to the second side of the outer corner (e.g., left turn) to complete the patching cleaning action. Another optional edge patching cleaning strategy is rotating patching, which is the same as the rotating patching when sweeping cleaning along the outer corner through the brushing member and is not repeated here.

Figure 11:
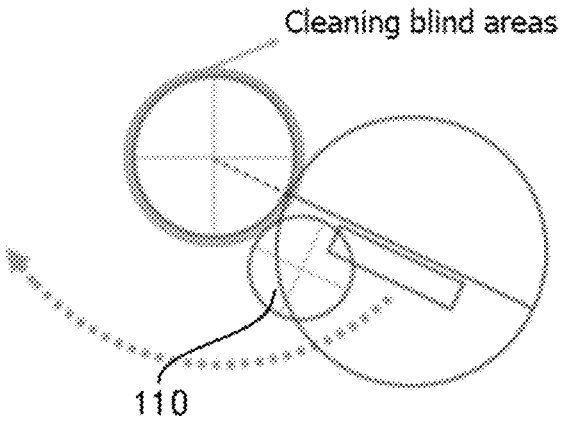
FIG. 11 and FIG. 12 are schematic diagrams of a cleaning blind area during a cleaning along a cylindrical body according to some embodiments of the disclosure.
Figure 12:
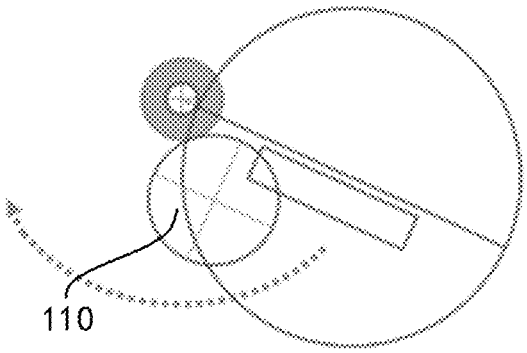
Figure 13:
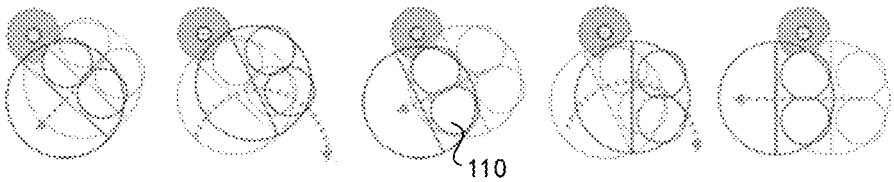
FIG. 13 is a schematic diagram of an edge patching cleaning strategy corresponding to a cleaning along a cylindrical body according to an embodiment of the disclosure.

Referring to FIG. 11, the cleaning robot sweeps and cleans along the cylindrical body, and referring to FIG. 12, the cleaning robot mops and cleans along the cylindrical body. When the cleaning robot performs edge cleaning to the cylindrical body in a routine cleaning task, there is a cleaning blind area shown by the gray circle surrounding the cylindrical body, such as a missed area. The cylindrical body includes, but is not limited to, a cylinder, a table leg, or a chair leg. FIG. 13 shows an embodiment of the edge patching cleaning strategy corresponding to the work scene of sweeping cleaning along the cylindrical body or mopping cleaning along the cylindrical body, which can be called tangential cleaning strategy, such as controlling the cleaning robot to rotate clockwise (or counterclockwise, depending on the position relationship between the cylindrical body and the cleaning robot) at a certain angle every time it travels straight ahead tangentially along the cylindrical body based on the edge cleaning motion in the routine cleaning task, allowing the traveling direction of the cleaning robot to be tangential to the cylindrical body again, and repeating straight ahead and rotary motion. In FIG. 13, it can be seen that the cleaning robot can perform patching cleaning on the cleaning blind area shown by the gray circle each time it travels straight ahead along the tangential direction, and the higher the frequency of rotation, the more times the side brush/mop is tangent to the cylindrical body, and the larger the area to be patching cleaned.

In some embodiments, the method further includes: obtaining a cleaning task map; and controlling the cleaning robot to at least clean the preset cleaning region through the mopping member according to the cleaning task map; upon determining that the edge patching cleaning condition is satisfied, controlling the cleaning robot to perform the edge patching cleaning task according to at least one preset frequency; when a carpet is detected, controlling the cleaning robot to explore the carpet along the edge to obtain the contour of the carpet; and adding a carpet area corresponding to the carpet into the cleaning task map according to the contour of the carpet.

Illustratively, the cleaning robot can be controlled to mop (or simultaneously sweep and mop) on the non-carpet area in the preset cleaning region according to the cleaning task map, and when the edge patching cleaning condition is satisfied, the cleaning robot is controlled to perform the edge patching cleaning task according to the at least one preset frequency so as to clean at least part of the cleaning blind area. The carpet can be detected during cleaning of the non-carpet area, for example by means the sensor unit. When the carpet is detected, the cleaning robot is controlled to explore the carpet along the edge, determine the carpet area corresponding to the carpet, and update the carpet area to the cleaning task map.

Illustratively, the method further includes: controlling the cleaning robot to clean the carpet in the carpet area by the brushing member according to the carpet area in the cleaning task map when the carpet cleaning condition is satisfied. Illustratively, after all non-carpet areas in the cleaning task map have been mopped, or all non-carpet areas in the preset cleaning regions have been cleaned, it is determined that the carpet cleaning condition is satisfied, and the cleaning robot is controlled to clean the carpet in the carpet area by means of the brushing member. Illustratively, when the carpet cleaning switch (button on the base station/cleaning robot or virtual switch on the user terminal) is set to be on, it is possible to control the cleaning robot to clean the carpet of the carpet area through the brushing member after all non-carpet areas have been mopped. Optionally, after cleaning all non-carpet areas, the mopping member is maintained, e.g., the mopping member is cleaned and dried, and then the carpet is cleaned according to the cleaning order of the carpet areas. The carpet is cleaned after the mop is dried to prevent wetting of the carpet.

The method for controlling the cleaning robot provided by the embodiments of the present disclosure includes: obtaining one or at least two preset frequencies of the edge patching cleaning task, and controlling the cleaning robot to perform the edge patching cleaning task on the preset cleaning region according to the preset frequency. The cleaning effect of the preset cleaning region can be improved by controlling the cleaning robot to perform the edge patching cleaning task, and by controlling the cleaning robot to perform the boundary patch cleaning task according to the preset frequency, the cleaning efficiency and the cleaning effect can be balanced, so the cleaning robot is more intelligent, and the user experience is better.

Figure 14:
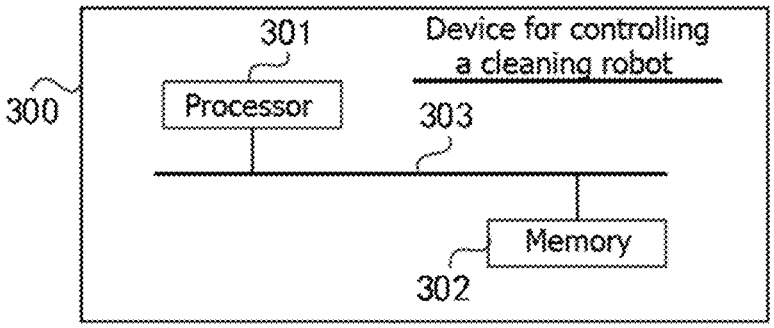
FIG. 14 is a schematic block diagram of a device for controlling the cleaning robot provided by an embodiment of the disclosure.

In combination with the above embodiments and referring to FIG. 14, FIG. 14 is a schematic block diagram of the control apparatus 300 according to an embodiment of the present disclosure. The control apparatus 300 includes a processor 301 and a memory 302.

Illustratively, the processor 301 and the memory 302 are connected by a bus 303, such as an Inter-Integrated Circuit (I2C) bus.

The processor 301 may be a Micro-Controller Unit (MCU), a central processing unit (CPU), or a digital signal processor (DSP), etc.

The memory 302 may be a FLASH chip, a read-only memory (ROM) disk, an optical disk, a USB flash disk, or a mobile hard disk.

The processor 301 is configured for running computer-executable instructions stored in the memory 302 and implementing the steps of the method when executing the computer-executable instructions.

Illustratively, the processor 301 is configured to run the computer-executable instructions stored in the memory 302, and implement the following steps when executing the computer-executable instructions:

obtaining a cleaning task map;

judging whether the cleaning task map includes a carpet area, and when the cleaning task map includes a carpet area, controlling the cleaning robot to clean the carpet in the carpet area through the brushing member; and controlling the cleaning robot to clean at least a portion of the non-carpet area in the cleaning task map at least by the mopping member.

The specific principle and implementation mode of the control apparatus provided by the embodiment of the disclosure are similar to the aforementioned method in the embodiment, and are not repeated here.

The embodiments of the disclosure further provide a base station, and the base station is at least configured for cleaning the mopping member of the cleaning robot. The base station further includes a control apparatus 300, such as a base station controller, for implementing the steps of the method in the embodiments of the disclosure.

The embodiments of the disclosure further provide a cleaning robot, the cleaning robot includes a control apparatus 300, such as a robot controller, which is configured for implementing the steps of the method in the embodiments of the disclosure.

The embodiments of the disclosure further provide a computer readable storage medium, the computer readable storage medium stores computer-executable instructions, and the computer-executable instructions, when executed by a processor, cause the processor to realize the steps of the method.

The computer readable storage medium may be an internal storage unit of the control apparatus described in any one of the foregoing embodiments, such as a hard disk or a memory of the control apparatus. The computer readable storage medium can also be an external storage device of the control apparatus, such as a plug-in hard disk, a Smart Media Card (SMC), a Secure Digital (SD) card, or a flash card (Flash Card) which is arranged on the control apparatus.

In combination with the above embodiments and referring to FIG. 2, FIG. 2 is a schematic diagram of a cleaning system according to an embodiment of the disclosure.

As shown in FIG. 2 to FIG. 3, the cleaning system includes:

the cleaning robot 100, including a traveling unit and a mopping member 110, and may further a brushing member 120. The traveling unit is configured for driving the cleaning robot 100 to move, allowing the mopping member 110 to mop the ground; the brushing member 120 includes a side brushing member 121 and/or a middle brushing member 122;

the base station 200, at least configured for cleaning or replacing the mopping member 110 of the cleaning robot 100; and/or the base station 200 including a dirt detection device so as to detect the dirtiness degree of the mopping member 110 of the cleaning robot 100; and the control apparatus 300.

The specific principle and implementation mode of the cleaning system provided by the embodiment of the disclosure are similar to the method in the aforementioned embodiments, and are not repeated here.

It should be understood that the terminology used in the present disclosure is only for the purpose of describing particular embodiments and is not intended to limit the disclosure.

In some embodiments, the present disclosure further provides a method for controlling a cleaning robot, which is configured to control the cleaning robot to clean a preset cleaning region. The method includes: obtaining one preset frequency or at least two preset frequencies of an edge patching cleaning task; and controlling the cleaning robot to perform an edge patching cleaning task on the preset cleaning region according to the preset frequency/frequencies.

In some embodiments, the preset cleaning region includes a room boundary and/or an obstacle contour. The controlling the cleaning robot to perform an edge patching cleaning task on the preset cleaning region according to the preset frequency/frequencies, includes: controlling the cleaning robot to execute a patching cleaning action during performing edge cleaning motion along the room boundary and/or the obstacle contour according to the preset frequency/frequencies.

In some embodiments, the preset cleaning region includes a room boundary and/or an obstacle contour, and the controlling the cleaning robot to perform an edge patching cleaning task, includes: controlling the cleaning robot to perform boustrophedon cleaning motion on the preset cleaning region, and controlling the cleaning robot to execute a turn around action to allow a coverage range of a cleaning member of the cleaning robot covering at least part of a cleaning blind area when the cleaning robot travels to the room boundary or the obstacle contour along a straight line, wherein the cleaning blind area is an area between a boundary line of the coverage range of the cleaning member and the room boundary and/or the obstacle contour during the cleaning robot performing edge cleaning motion.

In some embodiments, before the controlling the cleaning robot to perform boustrophedon cleaning motion on the preset cleaning region, the method further includes: controlling the cleaning robot to perform edge cleaning motion on the preset cleaning region.

In some embodiments, the method further includes: obtaining an object type of an edge patching cleaning object; and the controlling the cleaning robot to perform an edge patching cleaning task on the preset cleaning region according to the preset frequency/frequencies, including: determining a preset frequency corresponding to the object type of the edge patching cleaning object; and controlling the cleaning robot to perform the edge patching cleaning task on the preset cleaning region according to the preset frequency corresponding to the object type.

In some embodiments, the preset frequency includes a first preset frequency and a second preset frequency, the first preset frequency is higher than the second preset frequency, and the object type includes a suspended obstacle and a non-suspended obstacle. The controlling the cleaning robot to perform the edge patching cleaning task on the preset cleaning region according to the preset frequency corresponding to the object type, includes: in case determining that the edge patching cleaning object is the suspended obstacle, controlling the cleaning robot to perform edge patching cleaning along the suspended obstacle according to the first preset frequency; and in case determining that the edge patching cleaning object is the non-suspended obstacle, controlling the cleaning robot to perform edge patching cleaning on the non-suspended obstacle according to the second preset frequency.

In some embodiments, the preset frequency includes a third preset frequency and a fourth preset frequency, the third preset frequency is higher than the fourth preset frequency, and the object type includes a discrete obstacle and an aggregated obstacle. The controlling the cleaning robot to perform the edge patching cleaning task on the preset cleaning region according to the preset frequency corresponding to the object type, includes: in case determining that the edge patching cleaning object is the discrete obstacle, controlling the cleaning robot to perform edge patching cleaning along the discrete obstacle according to the third preset frequency; and in case determining that the edge patching cleaning object is the aggregated obstacle, controlling the cleaning robot to perform edge patching cleaning on the aggregated obstacle according to the fourth preset frequency.

In some embodiments, the edge patching cleaning object corresponds to at least two object types, and each object type corresponds to a preset frequency. The controlling the cleaning robot to perform the edge patching cleaning task on the preset cleaning region according to the preset frequency corresponding to the object type includes: performing edge patching cleaning on the preset cleaning region according to a highest preset frequency of the preset frequencies corresponding to the at least two object types.

In some embodiments, the method further includes: obtaining an environment type of an area where an edge patching cleaning object is located. The controlling the cleaning robot to perform the edge patching cleaning task on the preset cleaning region according to the preset frequency, includes: controlling the cleaning robot to perform the edge patching cleaning task on the preset cleaning region according to a preset frequency corresponding to the environment type.

In some embodiments, the preset frequency includes a fifth preset frequency and a sixth preset frequency, and the fifth preset frequency is higher than the sixth preset frequency. The controlling the cleaning robot to perform the edge patching cleaning task on the preset cleaning region according to the preset frequency corresponding to the environment type includes: in case determining that the environment type of the area where the edge patching cleaning object is located is a public area, controlling the cleaning robot to perform edge patching cleaning on a room boundary of the public area and/or an obstacle contour of the public area according to the fifth preset frequency; and in case determining that the environment type of the area where the edge patching cleaning object is located is a non-public area, controlling the cleaning robot to perform edge patching cleaning on a room boundary of the non-public area and/or an obstacle contour of the non-public area according to the sixth preset frequency.

In some embodiments, the preset frequency includes a seventh preset frequency and an eighth preset frequency, and the seventh preset frequency is higher than the eighth preset frequency. The controlling the cleaning robot to perform the edge patching cleaning task on the preset cleaning region according to the preset frequency corresponding to the environment type, includes: in case determining that the environment type of an area where the edge patching cleaning object is located is a narrow area, controlling the cleaning robot to perform edge patching cleaning on a room boundary of the narrow area and/or an obstacle contour of the narrow area according to the seventh preset frequency; and in case determining that the environment type of an area where the edge patching cleaning object is located is a non-narrow area, controlling the cleaning robot to perform edge patching cleaning on a room boundary of the non-narrow area and/or an obstacle contour of the non-narrow area according to the eighth preset frequency.

In some embodiments, an area where the edge patching cleaning object is located corresponds to at least two environment types, and each environment type corresponds to a preset frequency. The controlling the cleaning robot to perform the edge patching cleaning task according to the preset frequency corresponding to the environment type, includes: controlling the cleaning robot to perform edge patching cleaning on the edge patching cleaning object of the preset cleaning region according to a highest preset frequency of preset frequencies corresponding to a plurality of environment types.

In some embodiments, the method further includes: obtaining an object type of an edge patching cleaning object; and obtaining an environment type of an area where the edge patching cleaning object is located. The controlling the cleaning robot to perform the edge patching cleaning task on the preset cleaning region according to the preset frequency, includes: determining a preset frequency corresponding to the object type of the edge patching cleaning object; determining a preset frequency corresponding to the environment type of the area where the edge patching cleaning object is located; and controlling the cleaning robot to perform edge patching cleaning on the preset cleaning region according to a highest preset frequency of the preset frequency corresponding to the object type and the preset frequency corresponding to the environment type.

In some embodiments, the method further includes: obtaining a working scene of the cleaning robot, and the working scene including at least one of the following: sweeping cleaning along an inner corner, mopping cleaning along an inner corner, sweeping cleaning along an outer corner, mopping cleaning along an outer corner, sweeping cleaning along a cylindrical body, mopping cleaning along a cylindrical body, and mopping cleaning along a straight line. The controlling the cleaning robot to perform the edge patching cleaning task, includes: selecting a corresponding edge patching cleaning strategy according to the working scene of the cleaning robot; and controlling the cleaning robot to perform the edge patching cleaning task according to the edge patching cleaning strategy.

In some embodiments, the method further includes: obtaining a cleaning task map; controlling the cleaning robot to clean the preset cleaning region at least through a mopping member according to the cleaning task map; upon determining that an edge patching cleaning condition is satisfied, controlling the cleaning robot to perform the edge patching cleaning task according to at least one preset frequency; in response to a carpet being detected, controlling the cleaning robot to perform edge exploration on the carpet to obtain a contour of the carpet; and adding a carpet area corresponding to the carpet in the cleaning task map according to the contour of the carpet.

In some embodiments, the method further includes: upon determining that a carpet cleaning condition is satisfied, controlling the cleaning robot to clean the carpet in the carpet area through a brushing member according to the carpet area in the cleaning task map.

In some embodiments, the present disclosure further provides a control apparatus of a cleaning robot. The control apparatus includes a memory and a processor, the memory is configured for storing computer-executable instructions, and the processor is configured to execute the instructions to implement the method for controlling the cleaning robot according to any one of aforementioned methods.

In some embodiments, the present disclosure further provides a cleaning system including a cleaning robot, a base station, and the control apparatus. The cleaning robot includes a walking unit, a mopping member, and a brushing member. The walking unit is configured to drive the cleaning robot to move, and the mopping member and the brushing member are configured to clean a ground. The base station is at least configured to clean the mopping member of the cleaning robot.

In some embodiments, the present disclosure further provides a computer readable storage medium storing computer-executable instructions. The computer-executable instructions, when being executed by a processor, cause the processor to implement the method for controlling the cleaning robot according to any one of aforementioned methods.

It should also be understood that the term "and/or" as used in the present disclosure and the appended claims refers to any combination of one or more of the associated listed items and the possible combinations thereof, and includes these combinations.

The above is only specific embodiments of the disclosure, but the protection scope of the disclosure is not limited thereto, and any person skilled in the art would easily conceive of various equivalent modifications or substitutions within the technical scope disclosed in the disclosure, and these modifications or substitutions should be covered within the protection scope of the disclosure. Therefore, the protection scope of the disclosure shall be subject to the protection scope of the claims.

What is claimed is:

1. A method for controlling a cleaning robot, configured to control the cleaning robot to perform a routine cleaning task or an edge patching cleaning task on a preset cleaning region, the method comprising:

determining a length of time of a current cleaning task from the most recent performed edge patching cleaning task and/or a number of performed routine cleaning tasks since the most recent performed edge patching cleaning task;

comparing the length of time and/or the number of performed routine cleaning tasks with a preset frequency;

in case the length of time and/or the number of performed routine cleaning tasks is greater than or equal to the preset frequency, determining the current cleaning task as the edge patching cleaning task, and controlling the cleaning robot to perform the edge patching cleaning task on the preset cleaning region; and in case the length of time and/or the number of performed routine cleaning tasks is less than the preset frequency, determining the current cleaning task as the routine cleaning task, and controlling the cleaning robot to perform the routine cleaning task on the preset cleaning region;

wherein the routine cleaning task comprises performing edge cleaning on the preset cleaning region, and the edge patching cleaning task comprises performing patching cleaning on at least part of a cleaning blind area in the edge cleaning of the routine cleaning task, and the preset frequency refers to a preset length of time or a preset number of routine cleaning tasks between two consecutive edge patching cleaning tasks performed by the cleaning robot.

2. The method as claimed in claim 1, wherein, the controlling the cleaning robot to perform the routine cleaning task on the preset cleaning region, comprises:

controlling the cleaning robot to perform edge cleaning motion and/or global cleaning motion on the preset cleaning region;

the controlling the cleaning robot to perform the edge patching cleaning task on the preset cleaning region, comprises:

controlling the cleaning robot to perform patching cleaning action based on edge cleaning motion while performing the edge cleaning motion on the preset cleaning region; and/or controlling the cleaning robot to perform the patching cleaning action based on global cleaning motion while performing the global cleaning motion on the preset cleaning region.

3. The method as claimed in claim 2, wherein the preset cleaning region comprises a room boundary and/or an obstacle contour;

the controlling the cleaning robot to perform patching cleaning action based on edge cleaning motion while performing the edge cleaning motion on the preset cleaning region, comprises:

controlling the cleaning robot to perform at least one of the following patching cleaning actions while performing the edge cleaning motion on the preset cleaning region: rotating by changing angular velocity, turning by changing angular velocity and linear velocity, and moving forward or backward by changing linear velocity.

4. The method as claimed in claim 3, further comprising:

obtaining a working scene of the cleaning robot, and the working scene comprising at least one of the following: sweeping cleaning along an inner corner, mopping cleaning along an inner corner, sweeping cleaning along an outer corner, mopping cleaning along an outer corner, sweeping cleaning along a cylindrical body, mopping cleaning along a cylindrical body, and mopping cleaning along a straight line;

wherein the controlling the cleaning robot to perform at least one of the following patching cleaning actions while performing the edge cleaning motion on the preset cleaning region: rotating by changing angular velocity, turning by changing angular velocity and linear velocity, and moving forward or backward by changing linear velocity, comprises:

selecting a corresponding patching cleaning action according to the working scene of the cleaning robot; and controlling the cleaning robot to perform the corresponding patching cleaning action while performing the edge cleaning motion on the preset cleaning region.

5. The method as claimed in claim 2, wherein the preset cleaning region comprises a room boundary and/or an obstacle contour;

the controlling the cleaning robot to perform the patching cleaning action based on global cleaning motion while performing the global cleaning motion on the preset cleaning region, comprises:

controlling the cleaning robot to perform the global cleaning motion on the preset cleaning region and, when the cleaning robot travels in the vicinity of the room boundary and/or the obstacle contour, continuing to travel a preset distance toward the room boundary and/or the obstacle contour before performing a turning action, so that a coverage of a cleaning member of the cleaning robot covers at least a portion of the cleaning blind area.

6. The method as claimed in claim 5, wherein the global cleaning motion is boustrophedon cleaning motion;

the controlling the cleaning robot to perform the patching cleaning action based on global cleaning motion while performing the global cleaning motion on the preset cleaning region, comprises:

controlling the cleaning robot to perform the boustrophedon cleaning motion on the preset cleaning region and, when the cleaning robot travels in a straight line to the vicinity of the room boundary and/or the obstacle contour, continuing to travel a preset distance toward the room boundary and/or the obstacle contour before performing a U-turning action, so that a coverage of a cleaning member of the cleaning robot covers at least a portion of the cleaning blind area.

7. The method as claimed in claim 5, wherein before the controlling the cleaning robot to perform the global cleaning motion on the preset cleaning region, the method further comprises:

controlling the cleaning robot to perform the edge cleaning motion on the preset cleaning region.

8. The method as claimed in claim 1, wherein the in case the length of time and/or the number of performed routine cleaning tasks is greater than or equal to the preset frequency, determining the current cleaning task as the edge patching cleaning task, and controlling the cleaning robot to perform the edge patching cleaning task on the preset cleaning region, comprises:

in case the length of time is greater than or equal to the preset length of time or the number of performed routine cleaning tasks is greater than or equal to the preset number of routine cleaning tasks, determining the current cleaning task as the edge patching cleaning task, and controlling the cleaning robot to perform the edge patching cleaning task on the preset cleaning region; or in case the number of performed routine cleaning tasks is greater than or equal to the preset number of routine cleaning tasks, comparing the length of time and the preset length of time, in case the length of time is greater than or equal to the preset length of time, determining the current cleaning task as the edge patching cleaning task, and controlling the cleaning robot to perform the edge patching cleaning task on the preset cleaning region.

9. The method as claimed in claim 1, further comprising:

obtaining an object type of an edge patching cleaning object;

and, the controlling the cleaning robot to perform the edge patching cleaning task on the preset cleaning region, comprising:

determining a preset frequency corresponding to the object type of the edge patching cleaning object; and controlling the cleaning robot to perform the edge patching cleaning task on the preset cleaning region according to the preset frequency corresponding to the object type.

10. The method as claimed in claim 9, wherein the preset frequency comprises a first preset frequency and a second preset frequency, the first preset frequency is higher than the second preset frequency, and the object type comprises a suspended obstacle and a non-suspended obstacle, and the controlling the cleaning robot to perform the edge patching cleaning task on the preset cleaning region according to the preset frequency corresponding to the object type, comprises:

in case determining that the edge patching cleaning object is the suspended obstacle, controlling the cleaning robot to perform edge patching cleaning along the suspended obstacle according to the first preset frequency; and in case determining that the edge patching cleaning object is the non-suspended obstacle, controlling the cleaning robot to perform edge patching cleaning on the non-suspended obstacle according to the second preset frequency.

11. The method as claimed in claim 9, wherein the preset frequency comprises a third preset frequency and a fourth preset frequency, the third preset frequency is higher than the fourth preset frequency, and the object type comprises a discrete obstacle and an aggregated obstacle, and the controlling the cleaning robot to perform the edge patching cleaning task on the preset cleaning region according to the preset frequency corresponding to the object type, comprises:

in case determining that the edge patching cleaning object is the discrete obstacle, controlling the cleaning robot to perform edge patching cleaning along the discrete obstacle according to the third preset frequency; and in case determining that the edge patching cleaning object is the aggregated obstacle, controlling the cleaning robot to perform edge patching cleaning on the aggregated obstacle according to the fourth preset frequency.

12. The method as claimed in claim 9, wherein the edge patching cleaning object corresponds to at least two object types, and each object type corresponds to a preset frequency; and the controlling the cleaning robot to perform the edge patching cleaning task on the preset cleaning region, comprises:

performing edge patching cleaning on the preset cleaning region according to a highest preset frequency of the preset frequencies corresponding to the at least two object types.

13. The method as claimed in claim 1, further comprising:

obtaining an environment type of an area where an edge patching cleaning object is located;

and, the controlling the cleaning robot to perform the edge patching cleaning task on the preset cleaning region, comprises:

controlling the cleaning robot to perform the edge patching cleaning task on the preset cleaning region according to a preset frequency corresponding to the environment type.

14. The method as claimed in claim 13, wherein the preset frequency comprises a fifth preset frequency and a sixth preset frequency, and the fifth preset frequency is higher than the sixth preset frequency, and the controlling the cleaning robot to perform the edge patching cleaning task on the preset cleaning region according to the preset frequency corresponding to the environment type, comprises:

in case determining that the environment type of the area where the edge patching cleaning object is located is a public area, controlling the cleaning robot to perform edge patching cleaning on a room boundary of the public area and/or an obstacle contour of the public area according to the fifth preset frequency; and in case determining that the environment type of the area where the edge patching cleaning object is located is a non-public area, controlling the cleaning robot to perform edge patching cleaning on a room boundary of the non-public area and/or an obstacle contour of the non-public area according to the sixth preset frequency.

15. The method as claimed in claim 13, wherein the preset frequency comprises a seventh preset frequency and an eighth preset frequency, and the seventh preset frequency is higher than the eighth preset frequency, and the controlling the cleaning robot to perform the edge patching cleaning task on the preset cleaning region according to the preset frequency corresponding to the environment type, comprises:

in case determining that the environment type of an area where the edge patching cleaning object is located is a narrow area, controlling the cleaning robot to perform edge patching cleaning on a room boundary of the narrow area and/or an obstacle contour of the narrow area according to the seventh preset frequency; and in case determining that the environment type of an area where the edge patching cleaning object is located is a non-narrow area, controlling the cleaning robot to perform edge patching cleaning on a room boundary of the non-narrow area and/or an obstacle contour of the non-narrow area according to the eighth preset frequency.

16. The method as claimed in claim 13, wherein an area where the edge patching cleaning object is located corresponds to at least two environment types, and each environment type corresponds to a preset frequency;

and, the controlling the cleaning robot to perform the edge patching cleaning task on the preset cleaning region, comprises:

controlling the cleaning robot to perform edge patching cleaning on the edge patching cleaning object of the preset cleaning region according to a highest preset frequency of preset frequencies corresponding to a plurality of environment types.

17. The method as claimed in claim 1, further comprising:

obtaining an object type of an edge patching cleaning object;

obtaining an environment type of an area where the edge patching cleaning object is located;

and, the controlling the cleaning robot to perform the edge patching cleaning task on the preset cleaning region, comprises:

determining a preset frequency corresponding to the object type of the edge patching cleaning object;

determining a preset frequency corresponding to the environment type of the area where the edge patching cleaning object is located; and controlling the cleaning robot to perform edge patching cleaning on the preset cleaning region according to a highest preset frequency of the preset frequency corresponding to the object type and the preset frequency corresponding to the environment type.

18. A control apparatus of a cleaning robot, wherein the control apparatus comprises a memory and a processor;

the memory is configured for storing computer-executable instructions; and the processor is configured to execute the instructions to implement a method for controlling the cleaning robot;

wherein, the method is configured to control the cleaning robot to perform a routine cleaning task or an edge patching cleaning task on a preset cleaning region, and the method comprises:

determining a length of time of a current cleaning task from the most recent performed edge patching cleaning task and/or a number of performed routine cleaning tasks since the most recent performed edge patching cleaning task;

comparing the length of time and/or the number of performed routine cleaning tasks with a preset frequency;

in case the length of time and/or the number of performed routine cleaning tasks is greater than or equal to the preset frequency, determining the current cleaning task as the edge patching cleaning task, and controlling the cleaning robot to perform the edge patching cleaning task on the preset cleaning region; and in case the length of time and/or the number of performed routine cleaning tasks is less than the preset frequency, determining the current cleaning task as the routine cleaning task, and controlling the cleaning robot to perform the routine cleaning task on the preset cleaning region;

wherein the routine cleaning task comprises performing edge cleaning on the preset cleaning region, and the edge patching cleaning task comprises performing patching cleaning on at least part of a cleaning blind area in the edge cleaning of the routine cleaning task, and the preset frequency refers to a preset length of time or a preset number of routine cleaning tasks between two consecutive edge patching cleaning tasks performed by the cleaning robot.

19. A computer readable storage medium, wherein the computer readable storage medium stores computer-executable instructions, and the computer-executable instructions, when being executed by a processor, cause the processor to implement a method for controlling the cleaning robot;

wherein, the method is configured to control the cleaning robot to perform a routine cleaning task or an edge patching cleaning task on a preset cleaning region, and the method comprises:

determining a length of time of a current cleaning task from the most recent performed edge patching cleaning task and/or a number of performed routine cleaning tasks since the most recent performed edge patching cleaning task;

comparing the length of time and/or the number of performed routine cleaning tasks with a preset frequency;

in case the length of time and/or the number of performed routine cleaning tasks is greater than or equal to the preset frequency, determining the current cleaning task as the edge patching cleaning task, and controlling the cleaning robot to perform the edge patching cleaning task on the preset cleaning region; and in case the length of time and/or the number of performed routine cleaning tasks is less than the preset frequency, determining the current cleaning task as the routine cleaning task, and controlling the cleaning robot to perform the routine cleaning task on the preset cleaning region;

wherein the routine cleaning task comprises performing edge cleaning on the preset cleaning region, and the edge patching cleaning task comprises performing patching cleaning on at least part of a cleaning blind area in the edge cleaning of the routine cleaning task, and the preset frequency refers to a preset length of time or a preset number of routine cleaning tasks between two consecutive edge patching cleaning tasks performed by the cleaning robot.

* * * * *